US005442570A

United States Patent [19]

Sashihara et al.

[11] Patent Number: 5,442,570

[45] Date of Patent: Aug. 15, 1995

[54] METHOD OF CONTROLLING HEAT INPUT TO AN ALLOYING FURNACE FOR MANUFACTURING HOT GALVANIZED AND ALLOYED BAND STEEL

[75] Inventors: Yoichi Sashihara; Masahiro Masuda; Isao Nakamura; Kunitoshi Watanabe; Tetsuya Miyazaki; Kazuhiro Sekimoto, all of Otemachi, Japan

[73] Assignee: Nippon Steel Corporation, Tokyo, Japan

[21] Appl. No.: 167,607

[22] Filed: Dec. 15, 1993

Related U.S. Application Data

[62] Division of Ser. No. 942,569, Sep. 9, 1992.

[30] Foreign Application Priority Data

| | | | |
|---|---|---|---|
| Sep. 10, 1991 | [JP] | Japan | 3-230218 |
| Sep. 10, 1991 | [JP] | Japan | 3-230219 |
| Sep. 10, 1991 | [JP] | Japan | 3-230220 |
| Oct. 8, 1991 | [JP] | Japan | 3-260874 |
| Oct. 8, 1991 | [JP] | Japan | 3-260875 |

[51] Int. Cl.[6] ..... G06F 15/46; C21B 5/00

[52] U.S. Cl. ..... 364/500; 364/502; 364/506; 364/472; 75/569; 75/380

[58] Field of Search ..... 364/500, 477; 75/58, 75/380, 569; 72/349; 76/107.1; 164/433; 148/548

[56] References Cited

U.S. PATENT DOCUMENTS

| | | | |
|---|---|---|---|
| 3,719,469 | 3/1973 | Roessing | 75/380 |
| 3,816,720 | 6/1974 | Bauer et al. | 364/500 |
| 4,579,022 | 4/1986 | Kasai et al. | 76/107.1 |
| 4,609,343 | 9/1986 | Tejfalussy | 364/477 |
| 4,652,299 | 3/1987 | Bienvenu et al. | 75/58 |
| 4,711,675 | 12/1987 | Yamamoto et al. | 148/548 |
| 4,830,088 | 5/1989 | Miller | 164/433 |
| 4,857,106 | 8/1989 | Wakimoto et al. | 364/472 |
| 5,085,712 | 2/1992 | Watanabe et al. | 148/548 |
| 5,179,854 | 1/1993 | Matsui et al. | 72/349 |
| 5,339,256 | 8/1994 | Levy et al. | 364/506 |

FOREIGN PATENT DOCUMENTS

| | | |
|---|---|---|
| 1252761 | 10/1989 | Japan . |
| 1279738 | 11/1989 | Japan . |

*Primary Examiner*—Emanuel T. Voeltz
*Assistant Examiner*—Alan H. Tran
*Attorney, Agent, or Firm*—Kenyon & Kenyon

[57] ABSTRACT

A method of calculating heat input to an alloying furnace which includes heat input means for use in the production of hot galvanized band steel comprising conveying a band steel of a selected steel variety through the alloying furnace and forming a plated deposition on the band steel in the alloying furnace comprising an alloyed layer of iron and zinc, establishing a formula defining a correlation between heat input and at least the steel variety, the plated deposition and the conveying speed of the band steel, inputting information which relates at least to the steel variety, the plated deposition, and the conveying speed, determining the heat input on the basis of the information inputted, and using the determined heat input to control the heat input means of the alloying furnace thereby controlling the formation of the iron and zinc alloyed layer plated deposition.

5 Claims, 25 Drawing Sheets

Cε:Compensation By Emissivity
Ct:Compensation By Plate Temperature (a)

(b)

METHOD OF CONTROLLING HEAT INPUT TO AN ALLOYING FURNACE FOR MANUFACTURING HOT GALVANIZED AND ALLOYED BAND STEEL

This is a division of application Ser. No. 07/942,569 filed on Sep. 9, 1992.

FIELD OF THE INVENTION

The invention relates to a control of a heat input to a heating zone of an alloying furnace used in a manufacturing step for a hot galvanized and alloyed band steel.

BACKGROUND OF THE INVENTION

In a manufacturing step for a hot galvanized and alloyed band steel, a band steel is generally subjected to a hot galvanizing bath to deposit a hot galvanized layer on the surface of the band steel, and the amount of plated deposition is reduced to a target value by blowing a gas to the surface of the band steel, followed by passing the band steel through an alloying furnace. The diffusion occurs as a result of a heat treatment within the furnace, whereby the plated layer is converted into an alloy of iron and zinc. Excellent flaking and powdering resistances are requisite important qualities for the hot galvanized and alloyed band steel which is manufactured in this manner. To obtain a hot galvanized and alloyed band steel having a preferable quality, it is necessary to control the temperature of the alloying furnace or the conveying speed of the band steel during the manufacturing step so that the degree of alloying, which may be represented by the percentage of iron content in the plated layer, for example, may be controlled to a given condition, thus preventing the occurrence of underalloying or overalloying.

For example, Japanese Laid-Open Patent Application No. 279,738/1989 discloses a manufacturing process in which the flaking resistance can be improved by specifying initial heat treatment conditions for the alloying treatment. Also Japanese Laid-Open Patent Application No. 252,761/1989 discloses a feedback control in which the degree of burning a burner or the magnitude of the heat input is regulated in accordance with a deviation between a measured plate temperature and a target plate temperature which is established on the basis of the conveying speed of the sheet steel, the amount of zinc deposited and Al concentration in the plating bath.

First Task:

It is possible to estimate the quality, in particular, the degree of alloying of a hot galvanized and alloyed band steel from process parameters, in particular, from the plate temperature of the band steel, or to estimate the degree of alloying from a measurement of the emissivity or reflectivity of the band steel. However, an alloying process is greatly complicated, and as a consequence, if the heat input is controlled so that the plate temperature approaches a predetermined target value or if the heat input is controlled so that the emissivity or reflectivity approaches its target value, the degree of alloying attained may sometimes miss the target value. When the degree of alloying is wanting, an unalloyed surface is likely to occur, causing a degradation in the quality of the hot galvanized and alloyed band steel.

Accordingly, it is a first task of the invention to obtain a hot galvanized and alloyed band steel of high quality even in actual operations involving large variations in the steel variety, conveying speed, plated depositions or the like by maintaining a proper control of the heat input to prevent the occurrence of unalloyed surfaces.

Second Task:

When performing a feedback control in which the heat input is compensated for in accordance with the deviation between a detected value and a target value by utilizing a plate thermometer to determine the temperature of the band steel, the plate thermometer must be located at a spaced location from the burner, so that in the event a change occurs in the temperature of the band steel, a time lag is caused until such change is actually detected by the plate thermometer. If such a temperature change is of an increased magnitude, a resulting error in the heat input being controlled which is caused by such time lag will result in the occurrence of a region of underalloying (unalloyed surface) or overalloying produced on the band steel, thus resulting in a reduced yield. In an actual manufacturing step, a number of steel coils are joined together, by soldering end to end, into a single band steel, which is then subjected into a continuous alloying treatment of hot galvanized band steel. However, in the region of joints between steel coils, operating parameters such as the steel variety, plate thickness, plate width, conveying speed, plated deposition or the like often change, and accordingly when such region is being treated, the time lag which is caused during the feedback control may result in a region of underalloying or overalloying being produced on the band steel.

It is to be understood that during a hot rolling and a cooling step which precedes the plating step, a leading and a trailing portion of the band steel is likely to be cooled more strongly than the remainder, and thus produce a differential effect of the cooling process which is dependent upon the location. This results in a differential or non-uniform composition of the rolled steel band. Accordingly, a cooling process called U-pattern cooling may be employed to provide a uniform composition of the band steel. Specifically, the degree of cooling applied to the leading and the trailing portion of the coil is reduced as compared with the remainder. A steel material which is subject to such U-pattern cooling (which is referred to as U-pattern material) presents a problem during the heat treatment of the hot galvanized steel in the alloying furnace in that the leading and the trailing portion are less subject to such heat treatment, and is likely to cause the occurrence of unalloyed surfaces. Such differential degree of treatment dependent on the location is not so remarkable for a steel material which is manufactured according to a normal cooling process. As a consequence, during the alloying treatment of U-pattern material, a conventional feedback control results in a region of insufficient treatment or overalloying and a consequent reduction in the yield, due to a time lag in the compensation of the heat input for the leading and the trailing end of the steel material.

Accordingly, it is a second task of the invention to enhance the yield of a hot galvanized and alloyed band steel by maintaining a proper control of the heat input so as to prevent the occurrence of an underalloying or overalloying in the actual operations involving large variations in the steel variety, conveying speed, plating deposition or the like and even when a band steel such as U-pattern material which is subject to a special cooling treatment is being treated.

Third Task:

It is possible to estimate the quality, in particular, the degree of alloying of a hot galvanized and alloyed band steel from process parameters, for example, from the plate temperature of the band steel. However, the complicated nature of the alloying process may cause the degree of alloying to miss its target value due to various factors even when the heat input is controlled so that the plate temperature approaches a predetermined target value. In particular, when the band steel changes from a variety which is amenable to alloying to another variety which is less amenable to alloying, an unalloyed surface is likely to occur to a substantial degree. When underalloying results in producing an unalloyed surface, the quality of the hot galvanized and alloyed band steel will be greatly degraded, thus reducing the yield.

Accordingly, it is a third task of the invention to obtain a hot galvanized and alloyed band steel of a high quality by maintaining a proper control of the heat input so as to prevent the occurrence of unalloyed surfaces in actual operations involving large variations in the steel variety, conveying speed, plating deposition or the like.

Fourth Task:

The degree of alloying of a band steel has a significant correlation with the optical reflectivity or emissivity of the band surface, and hence it is possible to determine the actual degree of alloying of the band steel from a measurement of the optical reflectivity or emissivity. Theoretically, it is possible to accurately compensate for the heat input by utilizing a feedback of such result to the control of the heat input.

However, in practice, the sensitivity of detecting an overalloying in accordance with a measurement of an optical reflectivity is substantially low even though the sensitivity of detecting the occurrence of an unalloyed surface in accordance with a measurement of the optical reflectivity or the like is relatively good. As a consequence, when attempting a control in which the heat input is increased in response to the occurrence of an unalloyed surface and is decreased in response to the detection of an overalloying by detecting unalloyed surfaces and overalloying on the basis of the measured optical reflectivity or emissivity, the resulting actual heat input tends to shift toward the overalloying (or excessive heat input) beyond the optimum heat input, with consequence that the powdering resistance of the band steel is degraded to reduce the product yield.

Accordingly, it is a fourth task of the invention to control the heat input to an alloying furnace so as to bring the degree of alloying of a hot galvanized and alloyed band steel to an optimum condition, thereby improving the yield of such band steel.

Fifth Task:

In an investigation conducted by the inventors, it is found that during the control of an alloying of a hot galvanized and alloyed band steel containing 6 to 13% of iron content in the plated alloy, the suppression of formation of $\zeta$ phase or the like in the surface of the plated layer is effective in improving the flaking resistance while when the band steel is passed through a heating zone and then through an insulated heated zone for purpose of achieving uniform alloying, a control on the basis of the heat input to the heating zone which is calculated on the basis of the steel variety, conveying speed, the plating depositions or the like is effective for the intended purpose.

However, the alloying process is complicated and non-linear. As a consequence, in actual operations involving large variations in the steel variety, conveying speed, the plating deposition or the like, a single formula cannot be relied on to provide a proper amount of heat input continuously. While a plurality of formulae may be provided which may be selectively used in accordance with the actual value of these parameters, it is very difficult to render a decision in choosing one of these formulae for a specified range of parameters in order to provide a proper heat input. In particular, for a boundary between the ranges across which a selected formula is changed, the proper heat input cannot be determined using either formula.

Accordingly, it is a fifth task of the invention to maintain a proper heat input in actual operations involving large variations in the steel variety, conveying speed, plating deposition or the like.

SUMMARY OF THE INVENTION

The first task is solved in accordance with a first invention in which during a step where a hot galvanized band steel is passed to an alloying furnace where it is heated to form an alloyed layer of iron and zinc on the band steel, a set point for the heat input is determined on the basis of the steel variety, the plated deposition and the conveying speed of the galvanized band steel during the control of the heat input to the alloying furnace, and target values for the temperature and the emissivity or reflectivity of the galvanized band steel at the outlet of the insulated heated zone of the furnace are determined on the basis of the steel variety, the plated deposition and the conveying speed of the galvanized band steel while measuring the actual temperature and the emissivity or reflectivity of the galvanized band steel, and the set point for the heat input is corrected so that the detected temperature and the emissivity or reflectivity of the galvanized band steel approach the respective target values without undershooting the target values.

In accordance with a second invention, the set point for the heat input is determined on the basis of the steel variety, the plated deposition and the conveying speed of the galvanized band steel, and the target values for the temperature and the emissivity or reflectivity of the galvanized band steel at the outlet of the insulated heated zone of the furnace are determined on the basis of the steel variety, the plated deposition and the conveying speed of the galvanized band steel. The actual temperature and the actual emissivity or reflectivity of the galvanized band steel are independently measured, and a first correction is formed in accordance with the detected temperature and an associated target value of the galvanized band steel. A second correction is formed in accordance with the detected value and a target value for the emissivity or reflectivity of the galvanized band steel. The set point of the heat input is corrected in accordance with a larger one of the first and the second correction.

In an investigation conducted by the inventors, it is found that during the control of alloying of a hot galvanized and alloyed band steel having 6 to 13% of iron content in the plated alloy, the suppression of formation of $\zeta$-phase or the like in the surface of the plated layer and the calculation and control of the heat input to the heating zone on the basis of the steel variety, the conveying speed and the plated deposition are effective in improving the flaking resistance. Accordingly, by calculating a set point for the heat input on the basis of the steel variety, the plated deposition and the conveying speed of the galvanized band steel, there is obtained a value of heat input which can be considered relatively appropriate.

However, such feed-forward control alone is not sufficient to accommodate for deviations between the actual operating conditions (the steel variety, the plated deposition and the conveying speed of the galvanized band steel) and the calculated value (set point). As a result of such deviations as well as a fluctuation in Al (aluminium) concentration in the plating bath, the preferred heat input which is required in practice deviates from the result of such calculation.

In order to compensate for such deviations, in the present invention, a first feedback compensation control which depends on the temperature of the galvanized band steel detected at the outlet of the insulated heated zone and a second feedback compensation control which depends on the emissivity (or optical reflectivity) of the galvanized band steel detected at the outlet of the heated zone are employed. The set point of the heat input is corrected so as to bring the detected temperature and the detected emissivity (or reflectivity) of the galvanized band steel closer to the respective target values while avoiding an undershooting thereof.

The temperature and the emissivity (or reflectivity) of the galvanized band steel is closely correlated with the degree of the band steel, so that when each of such variables is utilized to estimate the degree of alloying in correcting the heat input, it is possible to bring the degree of alloying of the band steel closer to the target value. However, it is noted that the correlation between the temperature of the galvanized band steel and the degree of alloying and the correlation between the emissivity (or reflectivity) of the band steel and the degree of alloying are produced by mutually different processes, so that when actually performing the first and the second feedback compensation control, an underalloying may be detected in response to the detected temperature in one instance and in response to the detected emissivity (or reflectivity) of the galvanized band steel in another.

In accordance with the present invention, since the set point for the heat input is corrected in order to bring the temperature and the emissivity (or reflectivity) of the galvanized band steel, each of which is correlated with the degree of alloying of the galvanized band steel, closer to the respective target values while avoiding an undershooting thereof, the correction of the heat input is made with preponderance on the requirement that underalloying be avoided. In other words, since a degradation in the quality resulting from overalloying is less than that caused by an underalloying, the control system in which the underalloying is initially detected obtains the preponderance, and the heat input is compensated for so that the alloying process is directed in a direction which is fail-safe in respect of the quality of the band steel.

In accordance with the second invention, a greater one of the first correction which depends on the detected temperature and the target value of the galvanized band steel and the second correction which depends on the detected value and the target value of the emissivity (or reflectivity) of the galvanized band steel is selected, and the set point of the heat input is corrected in accordance with the selected value so that the heat input may be corrected so as to bring the detected values of both the temperature and the emissivity (or reflectivity) of the galvanized band steel, each of which is correlated with the degree of alloying of the galvanized band steel, closer to the respective target values without causing an undershooting thereof.

The second task is solved in accordance with a third invention in which in a step subsequent to a hot rolling and cooling step where a hot galvanized band steel is passed to an alloying furnace where heat is applied to form an alloyed layer of iron and zinc on the band steel, a set point for the heat input to the alloying furnace is determined on the basis of the steel variety, the plated deposition and the conveying speed of the galvanized band steel during the heat input control, and temperature distribution pattern as plotted against the position of each band steel, which prevails during the cooling step which precedes the alloying treatment, is previously recognized. The location of the band steel which is then being subject to the alloying treatment is detected, and the set point for the heat input is compensated for in a manner corresponding to the detected location on each band steel an the basis of the temperature distribution pattern plotted against the location.

Additionally, in accordance with a fourth invention, at least one of the temperature, the emissivity and the optical reflectivity of the galvanized band steel is measured at the outlet of the insulated heated zone of the alloying furnace in order to detect the degree of alloying, and the set point for the heat input is corrected so as to bring the detected degree of alloying closer to the target value.

The heat input which provides an optimum degree of alloying for the quality of the band steel varies with operating conditions such as the steel variety, the plated deposition and the conveying speed or the like of the galvanized band steel. However, it is recognized that in actual operations, these operating conditions may be informed to a process computer, which controls the operation, before the band steel enters the alloying treatment furnace. The process computer is also capable of knowing whether the band steel is one which is subject to U-pattern cooling during a cooling step which follows the hot rolling operation or another which is subject to a normal cooling, again before the band steel enters the alloying furnace. Accordingly, without detecting the actual operating conditions by means of sensors, it is possible to obtain an adequate heat input for each band steel by performing a given calculation on the basis of a set of preset operating conditions for the respective band steels and the past performances of the manufacturing process. For processing a U-pattern material, the heat input may be adjusted by adding to the normal heat input a given amount of compensation which is based on the cooling pattern of such material and the past performances of the manufacturing process only during the time the leading and the trailing end of such material passes through the furnace, thereby avoiding the occurrence of regions of underalloying and overalloying over the entire length of the band steel. It is to be noted that such control represents a so-called feedforward control, which eliminates a time lag in the detection and in the resulting control which would occur when utilizing the feedback control. Accordingly, if the operating conditions are changed in the region of joints in the band steel or even when an alloying treatment of the U-pattern material is being made, the occurrence of regions of underalloying and overalloying can be minimized to enhance the yield in a reliable manner.

However, such feedforward control alone is not sufficient to overcome deviations between the actual operating conditions (the steel variety, the plated deposition and the conveying speed of the galvanized band steel) and the calculated value or the set point. In addition, a fluctuation in the Al concentration in the plating bath adds to such deviation, resulting in a difference between a favorable heat input which is required in actuality and the result Of calculation. However, in accordance with the invention, at least one of the temperature, the emissivity and the optical reflectivity of the galvanized band steel is detected at the outlet of the heated zone in order to detect the degree of alloying at that location, whereby the heat input can be compensated in a more appropriate manner through the feedback control which brings the detected value closer to the target value, thereby enhancing the yield.

The third task is solved in accordance with a fifth invention wherein in a step of passing a hot galvanized band steel through an alloying furnace where heat is applied to form an alloyed layer of iron and zinc on the band steel, a set point for the heat input to the furnace which is being controlled is determined on the basis of the steel variety, the plated deposition and the conveying speed of the galvanized band steel during the control of the heat input, the optical reflectivity of the surface of the band steel at the outlet of the heating zone of the furnace is detected, the occurrence of an underalloying is determined on the basis of the optical reflectivity, and the set point for the heat input is corrected in the event an underalloying is found.

In accordance with a sixth invention, the optical reflectivity of the surface of the band steel is detected at the outlet of the heating zone of the furnace, and a correction to be added to the set point for the heat input is determined in accordance with the magnitude of the optical reflectivity as well as a rate of change thereof.

In accordance with a seventh invention, at least one of the temperature, the emissivity and the optical reflectivity of the band steel is measured at the outlet of the insulated heated zone of the furnace in order to detect the degree of alloying at that location, and a set point for the heat input is corrected in accordance with a deviation between the detected degree of alloying and its associated target value.

As mentioned previously, the feedforward control alone is insufficient to overcome deviations between the actual operating conditions (the steel variety, the plated deposition and the conveying speed of the galvanized band steel) and calculated values (or set points) as well as a fluctuation in the Al (aluminium) concentration in the plating bath, resulting in a difference between a favorable heat input which is required in actuality and a result of calculation, giving rise to the occurrence of an underalloying. However, in accordance with the present invention, the degree of alloying can be maintained in a proper condition in a manner as described below.

Specifically, in accordance with the fifth invention, the optical reflectivity of the surface of the band steel is detected at the outlet of the heating zone of the alloying furnace, determining if an underalloying has or has not occurred on the basis of the optical reflectivity, and in the event the occurrence of an underalloying is found, the set point for the heat input is corrected. In this manner, if the heat input is wanting, the insufficient heat input can be modified at an early stage, contributing to enhancing the yield of the hot galvanized and alloyed band steel.

In accordance with the sixth invention, a compensation is determined on the basis of both the detected optical reflectivity as well as a change of rate thereof, thereby allowing an appropriate compensation of the heat input in the event an unalloyed surface is found.

Additionally, in accordance with the seventh invention, at least one of the temperature, the emissivity and the optical reflectivity of the band steel is measured at the outlet of the insulated heated zone of the alloying furnace in order to detect the degree of alloying at that location, and a set point for the heat input is corrected in accordance with a deviation between the detected degree of alloying and its associated target value so as to eliminate such deviation. Consequently, an error between the target value and the heat input which is actually required which results from deviations between set points and the actual values of the steel variety, the plated deposition and the conveying speed of the galvanized band steel as well as a fluctuation in the aluminium concentration in the plating bath can be compensated for by the feedback control. It is possible to detect the degree of alloying with a relatively good accuracy at the outlet of the insulated heated zone of the alloying furnace, thus enabling a highly accurate compensation of the heat input. While it is difficult to detect the degree of alloying with a high accuracy at the outlet of the heating zone of the furnace, it is a simple matter to detect on unalloyed surface through the reflectivity, and accordinly by detecting it at the outlet of the heating zone or earlier than the detection were made at the outlet of the heated zone to compensate for the heat input, a region of an occurring unalloyed surface can be minimized, thus contributing to enhancing the yield. By establishing a target value for the plate temperature at the outlet of the heated zone at a relatively low level, a band steel having an excellent powdering resistance can be manufactured without accompanying an overalloying and while preventing the occurrence of an unalloyed surface.

The fourth task is solved in accordance with an eighth invention wherein in a step of passing a hot galvanized band steel through an alloying furnace where heat is applied to form an alloyed layer of iron and zinc on the band steel, a set point for the heat input to the alloying furnace which is being controlled is determined on the basis of the steel variety, the plated deposition and the conveying speed of the galvanized band steel, the occurrence of an underalloying is determined at the outlet of a cooling zone of the alloying furnace, and after the process condition has been stabilized, a lower limit burning sequence compensating control is conducted in which the heat input is decrementally decreased and in the event the occurrence of an underalloying is detected at the outlet of the cooling zone, a compensating heat input which is sufficient to overcome the underalloying is added to the existing heat input, followed by interrupting a subsequent updating of the heat input.

In accordance with a ninth invention, at least one of the temperature, the emissivity and the optical reflectivity of the band steel is measured at the outlet of the insulated heated zone of the alloying furnace in order to detect the degree of alloying at that location, and a set point for the heat input is corrected in accordance with the deviation between the detected degree of alloying and its associated target value.

Additionally, in accordance with a tenth invention, the optical reflectivity of the surface of the band steel is detected at the outlet of the heating zone of the alloying furnace, the occurrence of an underalloying at the outlet of the heating zone of the furnace is determined on the basis of the optical reflectivity, and in the event the occurrence of an underalloying is found, the heat input is corrected.

As mentioned previously, when the degree of alloying is detected by the measurement of an optical reflectivity or the like, a high detection sensivity is achieved for an underalloying while the detection sensitivity for an overalloying is low. In an investigation conducted by the inventors, it is found that an optimum degree of alloying is that degree of alloying which is slightly higher than the condition in which the occurrence of spotwise regions of a higher optical reflectivity on the surface of the band steel, which may be considered as indicating "nearly alloyed surface", which also represents a degree of underalloying, is removed. In accordance with the invention, by conducting the lower limit burning sequence compensating control, the heat input is automatically adjusted to provide such an optimum degree of alloying. Thus, subsequent to the stabilization of the process, as the heat input is decrementally reduced, the regions of higher optical reflectivities occur spotwise shortly. Upon detecting such occurrence, the existing heat input is chosen as a reference, to which a given compensation is added to modify the heat input, which then provides an optimum heat input. Since a sufficiently high detection sensitivity is available for detecting the underalloying, a compensation of the heat input can be achieved with a high accuracy by modifying the heat input with reference to a condition where a slight degree of underalloying occurs or the condition when the spotwise regions of higher optical reflectivity are initially detected.

As the operating conditions such as the steel variety, the plated deposition (target value), the conveying speed or the like are changed, the optimum heat input varies in a corresponding manner. Accordingly, the lower limit burning sequence compensating control is performed when the process is stabilized, avoiding a time interval when such operating conditions are changing.

As mentioned, the feedforward control alone is not sufficient to overcome deviations between the actual operating conditions and the calculated values or set points, giving rise to the occurrence of underalloying or overalloying. However, a proper degree of alloying can be maintained in accordance with the invention in a manner mentioned below.

Specifically, in accordance with a ninth invention, at least one of the temperature, the emissivity and the optical reflectivity of the band steel is measured at the outlet of the insulated heated zone of the alloying furnace in order to detect the degree of alloying which prevails at that location, and a set point for the heat input is corrected in accordance with the deviation between the detected degree of alloying and its associated target value so as to remove such deviation. Consequently, an error between the target value of the heat input and the heat input which is actually required, which results from the described deviations and the fluctuation in the aluminium concentration in the plating bath, can be compensated for by the feedback control. The compensation can be accomplished with a high accuracy since the degree of alloying can be detected with a relatively good accuracy at the outlet of the heated zone of the furnace.

In accordance with a tenth invention, the optical reflectivity of the surface of the band steel is detected at the outlet of the heating zone of the furnace, the occurrence of an underalloying is determined on the basis of the optical reflectivity, and in the event the occurrence of an underalloying is found, a set point for the heat input is corrected, thus modifying any insufficient heat input at an early stage, which contributes to increasing the yield of the hot galvanized and alloyed band steel. This is possible because the detection of an underalloying in terms of the reflectivity is relatively simple to achieve at the outlet of the heating zone of the furnace even though the detection of the degree of alloying with a high accuracy is difficult. By detecting the underalloying at an early stage (namely, at the outlet of the heating zone rather than at the outlet of the insulated heated zone), and rapidly compensating for the heat input, a region of an underalloying can be minimized to enhance the yield.

The fifth task is solved in accordance with an eleventh invention wherein in a step of passing a hot galvanized band steel through an alloying furnace where heat is applied to form an alloyed layer of iron and zinc on the band steel, a formula for calculating a heat input to the furnace is defined in a two dimensional or higher order space including at least a steel variety constant axis and a plated deposition axis. The space is divided into two or more independent domains and boundary regions located between the plurality of independent domains, and a calculation formula is provided independently for each independent domain. Two or more membership functions are provided for each axis for determining a contribution of a boundary region to each independent domain. Using a steel variety constant inputted and its membership function, a contribution factor of the steel variety constant to each independent domain is calculated. Similarly, by using a plated deposition inputted and its membership function, a contribution factor of the plated deposition to each independent domain is calculated. A calculation is made on the basis of the calculation formula allocated to each independent domain and the calculated contribution factors to determine the heat input.

In accordance with a twelfth invention, the space which defines a formula for calculating the heat input is chosen as a three dimensional space including a steel variety constant axis, a plated deposition axis and a conveying speed axis. The space is divided into two or more independent domains and boundary regions located between the plurality of independent domains. A calculation formula is provided separately for each independent domain, and two or more membership functions are provided for each axis for determining a contribution factor of a boundary region to each independent domain. By using a steel variety constant inputted and its membership function, a contribution factor of the steel variety constant to each independent domain is calculated. Similarly, using the plated deposition inputted and its membership function, a contribution factor of the plated deposition to each independent domain is calculated. In a similar manner, using a conveying speed inputted and its membership function, a contribution factor of the conveying speed to each independent domain is calculated. A calculation is made on the basis of the calculation formula allocated to each independent domain and the calculated contribution factors to determine the heat input.

In accordance with the invention, the space which defines a formula for calculating the heat input is provided as a two dimensional or higher order space including at least the steel variety constant and plated deposition axis, and the space is defined into a plurality of domains each associated with a separate calculation formula. Accordingly, the heat input can be calculated for each independent domain using a calculation formula which is allocated to that domain. In a space located between adjacent independent domains, a contribution factor of that location to each independent domain is defined by the membership function, and the heat input is determined by using calculation formulae allocated to the respective independent domains, and a plurality of calculation formulae which are based on the determined contribution factors. Consequently, if a boundary between domains is not clearly defined, an appropriate use of the membership functions allows a result of calculation to be coincident with the heat input which is actually required for any boundary region. In other words, by adjusting the extent of the respective domains divided and the membership functions which define the contribution factors at the boundary between the domains, a result of calculation which exhibits a precise coincidence can be obtained for a very complicated alloying process.

Other objects and features of the invention will become apparent from the following description of an embodiment thereof.

DETAILED DESCRIPTION OF PREFERRED EMBODIMENTS

First Embodiment

Figure 1:
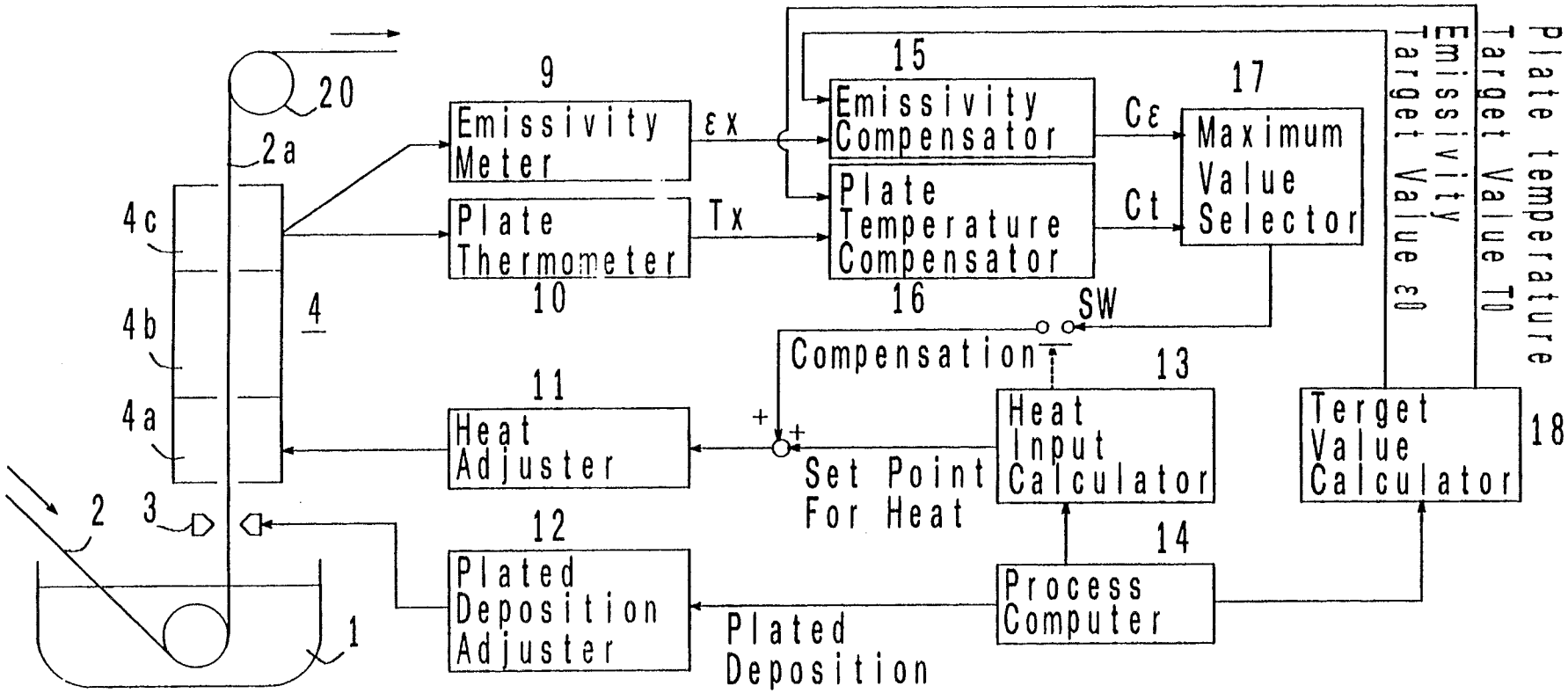
FIG. 1 is a block diagram showing an essential arrangement of a step for manufacturing a hot galvanized and alloyed band steel.

FIG. 1 shows an essential arrangement of a step for manufacturing a hot galvanized and alloyed band steel. Referring to FIG. 1, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone **4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c*, to form a zinc-iron alloy plated layer having an iron content on the order of 6 to 13% near its surface. Upon exiting the furnace 4, the band steel 2 is passed around a roll 20** to be conveyed to a successive step.

In this embodiment, heat is supplied to the heating zone **4*a* of the furnace by the combustion of a gas, and the heat input to the heating zone 4*a* is controlled by controling a flow rate of a fuel gas being supplied. This control takes place by a heat adjuster 11 adjusting the opening of a flow rate control valve which is not shown. A set point of the heat input (or target value) which is delivered from a heat input calculator 13 and a compensation from a feedback compensating control system to be described later are applied to the heat adjuster 11**.

A plate thermometer 10 which determines the plate temperature of the band steel 2 and an emissivity meter 9 which determines the emissivity of the surface of the band steel 2 are disposed at the outlet of the heated zone 4*b*. The plate temperature Tx determined by the thermometer 10 is input to a plate temperature compensator 16 while the emissivity $\epsilon x$ determined by the emissivity meter 9 is input to an emissivity compensator 10. An emissivity meter 9 which depends for its operation on the known principle of determining the emissivity is employed.

The flow rate of the gas which is blown from the nozzles 3 is controlled by a plated deposition adjuster 12, which responds to a set point of the plated deposition supplied as an input, by controlling the flow rate of the gas being supplied to the nozzles 3. A process computer 14 controls the entire step of manufacturing a hot galvanized and alloyed band steel. It delivers a set point for the plated deposition to a plated deposition adjuster 12, delivers information including the plated deposition, the steel variety, the conveying speed, the plate width and the plate thickness to the heat input calculator 13, and also delivers information including the plated deposition, the steel variety and the conveying speed to a target value calculator 18. In response to the furnace temperature which is inputted and information supplied including the plated deposition, the steel variety, the conveying speed, the plate width and the plate thickness, the heat input calculator 13 calculates the heat input Q, which is a set point for the heat input, according to the equation (1) shown below, and applies the result of calculation to the heat adjuster 11.

$$Q = a0 + a1 \times \text{furnace temperature} + a2 \times \text{plated deposition} \times \text{conveying speed} \times [1 + k1\,(\text{plate width} - \text{standard value Of plate width}) + k2\,(\text{plate thickness} - \text{standard value of plate thickness})] + a3 \times \text{steel variety constant} \quad (1)$$

where a0 to a3, and k1 and k2 represent constants.

The target value calculator 18 determines target values for the plate temperature and the emissivity on the basis of information which is delivered from the process computer 14. A target value T0 for the plate temperature is applied to a plate temperature compensator 16 while a target value $\epsilon 0$ for the emissivity is applied to an emissivity compensator 15, both of which are utilized for purpose of feedback control. These target values are calculated according to the equations indicated below.

$$T0 = b0 + b1 \times \text{plated deposition} + b2 \times \text{conveying speed} + b3 \times \text{steel variety constant} \quad (2)$$

$$\epsilon 0 = c0 + c1 \times \text{plated deposition} + c2 \times \text{conveying speed} + c3 \times \text{steel variety constant} \quad (3)$$

where b0 to b3 and c0 to c3 represent constants.

The heat input which is calculated by the heat input calculator 13 will be slightly offset from an optimum heat input as a result of deviations between the set points and the actual values of process parameters including the furnace temperature, the plated deposition, the conveying speed, the plate width, the plate thickness and the steel variety constant and also as a result of a fluctuation in the aluminium concentration in the molten zinc bath 1. In order to compensate for such an error, in the present embodiment, the degree of alloying of the band steel 2 is measured at the outlet of the heated zone 4*b*, and such measured value is used in a feedback compensating control.

Figure 2:
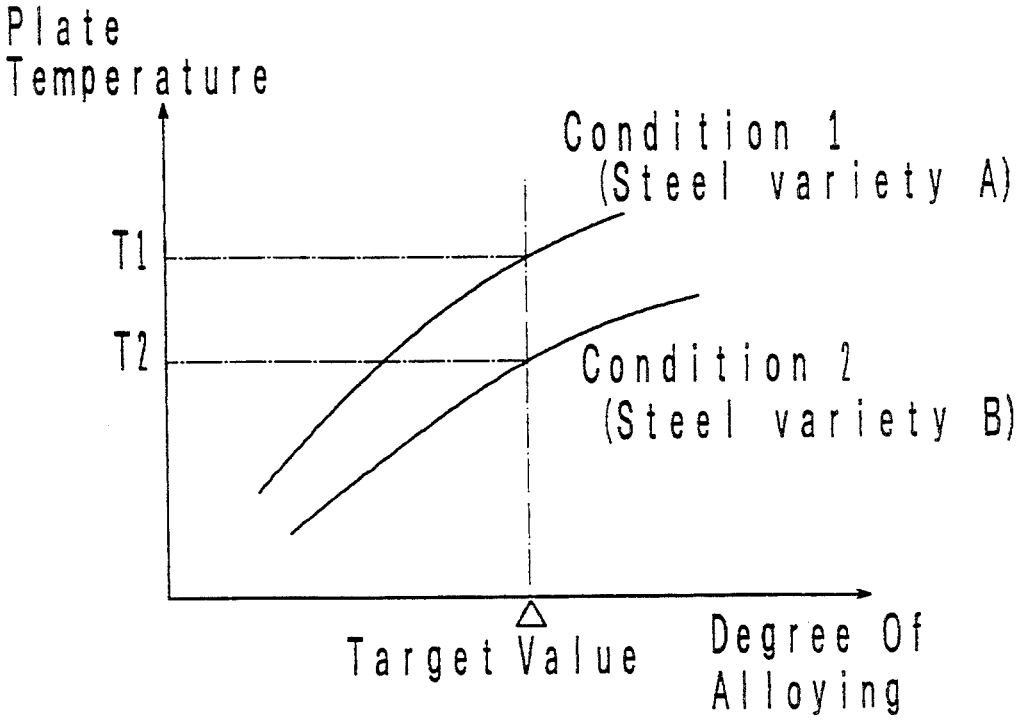
FIG. 2 graphically shows a correlation between the plate temperature, the degree of alloying and a correlation between the emissivity and the degree of alloying.
Figure 2:
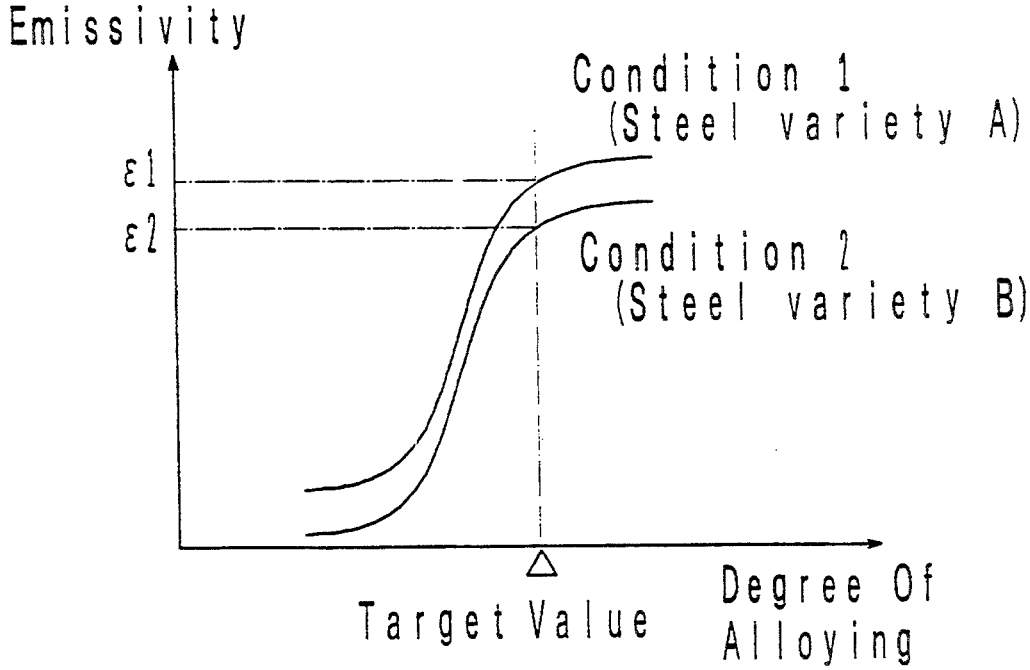

Specifically, the plate temperature and the emissivity of the band steel are respectively correlated with the degree of alloying as illustrated in FIG. 2. The higher the value of each parameter, the greater the resulting degree of alloying. However, it should be noted that the relationship therebetween is non-linear, and also varies with process parameters such as the steel variety, the conveying speed, the plated deposition or the like. It will be noted that as the alloying proceeds, the emissivity rapidly increases in magnitude while a rate of change in the emissivity with respect to a change in the degree of alloying will be reduced when a desirable degree of alloying is exceeded. In addition, it is to be noted that the plate temperature and the emissivity are not uniform crosswise of the band steel. Accordingly, it is necessary to measure the plate temperature and the emissivity over the entire width of the band steel in order to avoid an underalloying. A set of plate temperature data Tx and a set of emissivity data $\epsilon x$ which are determined over the entire width may be utilized in a number of ways, but in the present embodiment, a mean value Td of the set of plate temperature data as averaged across the width is chosen as a typical value which is utilized in a plate temperature compensating control while a minimum value $\epsilon d$ of the set of emissivity data as averaged over the width is chosen as a typical value which is utilized in an emissivity compensating control. It is found that such control is effective in detecting an underalloying.

The plate temperature compensator 16 which forms part of a feedback compensating control system calculates a compensation Ct in accordance with a deviation between a target value of the plate temperature T0 and a detected value of the plate temperature (a crosswise mean value) Td, which is then output to a maximum value selector 17. The emissivity compensator 15 which also forms part of the feedback compensating control system calculates a compensation $C\epsilon$ in accordance with the deviation between the target value of emissivity $\epsilon 0$ and the detected value of emissivity (crosswise minimum value) $\epsilon d$, which is then output to the maximum value selector 17. The maximum value selector 17 compares the two inputs of compensations Ct and $C\epsilon$, and selects whichever is the greater in magnitude, and applies the selected compensation through a switch SW for addition to the set point of the heat input (or target value) which is determined by the feedforward control system, to be applied to the heat input adjuster 11.

Figure 3:
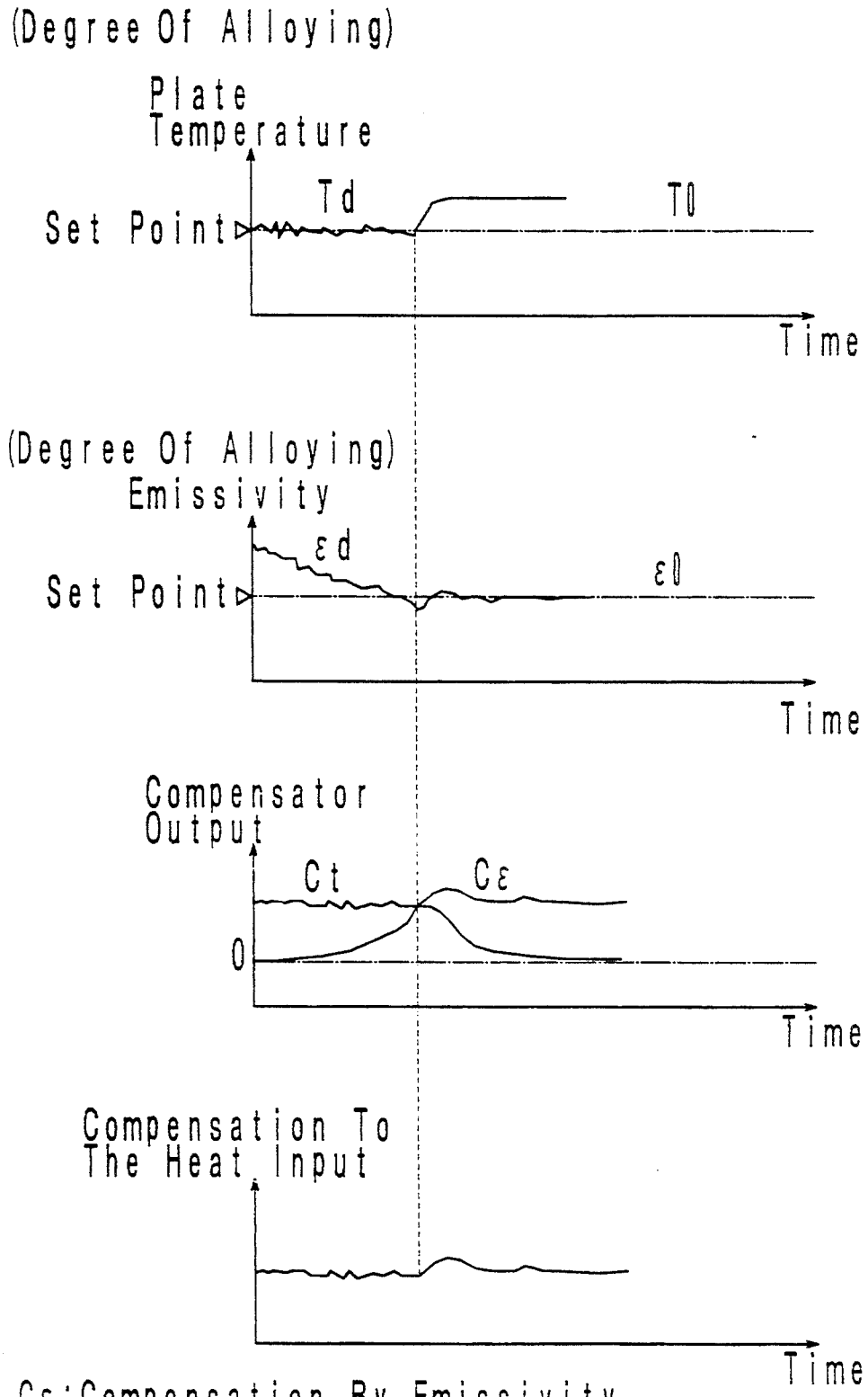
FIG. 3 is a timing chart illustrating an example of operation of a feedback compensating control system.

An example of operation of the feedback compensating control system is illustrated in FIG. 3. Referring to FIG. 3, the plate temperature compensation Ct is initially greater than the emissivity compensation $C\epsilon$, whereby the plate temperature compensation Ct is selected as the output from the selector 17 to serve as a compensation to the heat input, whereby the heat input is modified in a manner to reduce a deviation between the target value T0 (which is also a target value for the degree of alloying) and the detected value Td toward 0. As the emissivity compensation $C\epsilon$ increases gradually and when it exceeds in magnitude the plate temperature compensation Ct, or when the detected emissivity ed reduces below its target value $\epsilon 0$ (which is also a target value for the degree of alloying), the emissivity compensation $C\epsilon$ is selected as the compensation to the heat input, and the heat input is modified so that the detected value ed approaches the target value $\epsilon 0$.

Thus, by selecting one of the compensations Ct and $C\epsilon$ which is the greater as the compensation to the heat input, the plate temperature and the emissivity can be controlled so that they do not reduce below the respective set points or the degree of alloying does not undershoot a set point therefor. In this manner, the occurrence of an underalloying is prevented in a positive manner if the degree of alloying is estimated from either the plate temperature or the emissivity. Suppose that the smaller one of the compensations Ct and $C\epsilon$ corresponded to the proper degree of alloying. The control then will be diverted away from the target value in a direction to promote the degree of alloying. However, the quality problem is nevertheless less than when the underalloying is caused, and thus such control is fail-safe in operating the manufacturing step as far as the quality is concerned.

In addition to calculating the set point for the heat input on the basis of information delivered from the process computer 14, the heat input calculator 13 also controls the opening or closing of the switch SW. The switch SW is normally closed to maintain the feedback compensation on or effective, but whenever process parameters (such as the steel variety or the plated deposition or the like) which are delivered from the process computer 14 are changed at timing when a joint between adjacent steel coils passes through the furnace, the switch SW is temporarily opened to turn the feedback compensating control off.

While in the described embodiment, the emissivity of the band steel is used as means which is used to estimate the degree of alloying of the band steel, it is theoretically possible to replace the emissivity by the reflectivity of the surface of the band steel, which is a similar parameter. When the reflectivity is used, it exhibits a high magnitude when the degree of alloying is low, and exhibits a smaller value when the degree of alloying is high. Accordingly, the reflectivity may be used by controlling so that the reflectivity remains below a target value.

The equations (2) and (3) which are used to calculate the target value of the plate temperature T0 and the target value of the emissivity $\epsilon 0$ may be replaced by the following equations in which the conveying speed term is omitted.

$$T0 = b0 + b1 \times \text{plated deposition} + b2 \times \text{steel variety constant} \quad (4)$$

$$\epsilon 0 = c0 + c1 \times \text{plated deposition} + c2 \times \text{steel variety constant} \quad (5)$$

When the control is conducted so that the degree of alloying does not undershoot the lower limit, the target values T0 and $\epsilon 0$ may be replaced by constants.

Instead of the equation (1), the heat input may be estimated according to the following equations.

$$Q = a0 + a1 \times (\text{plated deposition} \times \text{conveying speed}) + a2 \times \text{steel variety constant} \quad (6)$$

$$Q = a0 + a1 \times \text{plated deposition} + a2 \times \text{conveying speed} + a3 \times \text{steel variety constant} \quad (7)$$

$$Q = a0 + a1 \times \text{furnace temperature} + a2 \times \text{plated deposition} + a3 \times \text{conveying speed} + a4 \times \text{plate width} + a5 \times \text{plate thickness} + a6 \times \text{steel variety constant} \quad (8)$$

In the described embodiment, the absolute value of the heat input Q has been calculated. However, in practice, the calculation of the heat input is repeatedly executed at a given period of time, and hence the control may be modified such-that a deviation of the heat input is repeatedly calculated, with a calculated deviation added to the existing heat input. In this instance, a deviation of the heat input may be calculated according to one of the following equations where a change in a variable which occurs during one calculation period ($\Delta t$) is denoted by $\Delta$.

$$\Delta Q = a0 + a1 \times \Delta \text{ furnace temperature} + a2 \times \Delta \text{ correction of heat input} + a3 \times \Delta \text{ steel variety constant} \quad (9)$$

$$\Delta \text{ correction of heat input} = \Delta\ [\text{plated deposition} \times \text{conveying speed} \times \{1 + k1\ (\text{plate width} - \text{standard value of plate width}) + k2\ (\text{plate thickness} - \text{standard value of plate thickness})\}] \quad (10)$$

$$\Delta Q = a0 + a1 \times \Delta\ (\text{plated deposition} \times \text{conveying speed}) + a2 \times \Delta \text{ steel variety constant} \quad (11)$$

$$\Delta Q = A0 + a1 \times \Delta \text{ plated deposition} + a2 \times \Delta \text{ conveying speed} + a3 \times \Delta \text{ steel variety constant} \quad (12)$$

$$\Delta Q = a0 + a1 \times \Delta \text{ furnace temperature} + a2 \times \Delta \text{ plated deposition} + a3 \times \Delta \text{ conveying speed} + a4 \times \Delta \text{ plate width} + a5 \times \Delta \text{ plate thickness} + a6 \times \Delta \text{ steel variety constant} \quad (13)$$

As discussed, the set point for the heat input is corrected to bring the detected temperature and emissivity (or reflectivity) of the galvanized band steel closer to the respective target values while preventing both the temperature and the emissivity (or reflectivity) of the galvanized band steel from undershooting the target value for the degree of alloying of the galvanized band steel. Accordingly, the correction of the heat input is made under the condition that the avoidance of an underalloying is a preponderant requirement. In other words, a compensation by a control system in which the underalloying is initially detected is given a higher priority. If the actual degree of alloying misses the target value, the control proceeds in a direction to promote the alloying, which does not accompany a significant degradation in the quality. In this manner, the compensation of the heat input takes place in a manner to direct the alloying process in a fail-safe direction for the quality of the band steel produced.

Second Embodiment

Figure 4:
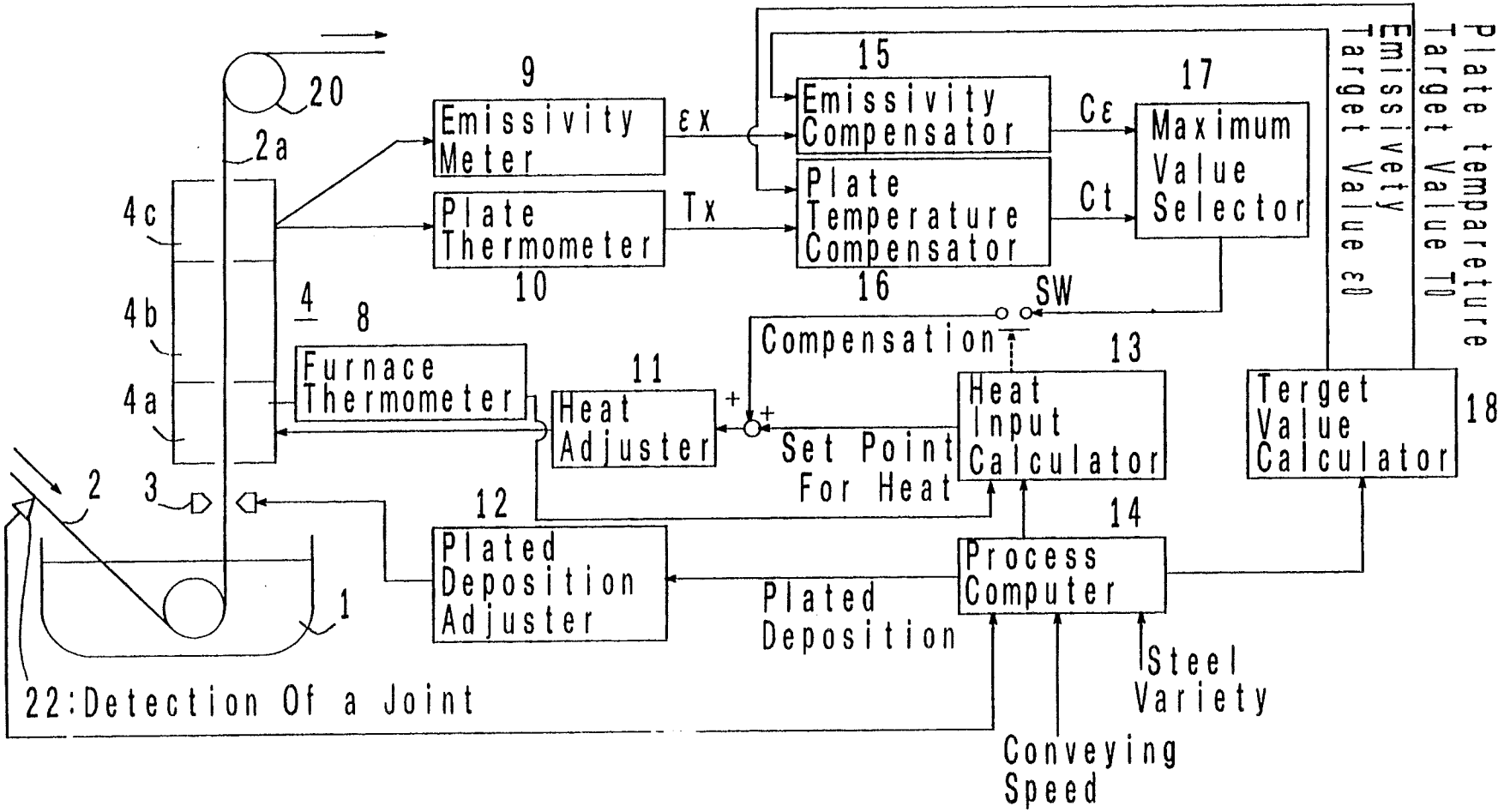
FIG. 4 is a block diagram showing an essential arrangement of a step of manufacturing a hot galvanized and alloyed band steel.

FIG. 4 shows an essential arrangement of another embodiment of the step for manufacturing a hot galvanized and alloyed band steel. It will be noted that the arrangement is generally similar to that shown in FIG. 1. Referring to FIG. 4, after passing through a hot rolling step and a cooling step, not shown, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone 4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c* to form a zinc-iron alloy plated layer having an iron content on the order of 6 to 13% near its surface. Upon exiting the furnace 4, the band steel 2 is passed around a roll 20 to be conveyed to a successive step.

It will be understood that steel materials which are coiled as a result of the rolling operation are joined together end-to-end to be introduced as a single band steel 2 into the step so that the plating treatment can be conducted continuously. A joint portion between adjacent steel materials or a joint Pn between coils is formed with an opening, not shown, in order to allow such location to be detected. Referring to FIG. 4, it will be noted that a joint detector 22 is disposed to detect such opening in an optical manner so that the location of each joint in the band steel 2 may be detected before it is fed into the plating step. Location information obtained by the joint detector 22 is fed to the process computer 14, which functions in the same manner as described before. Specifically, the steel variety of each coil which constitutes together the band steel 2 (including a distinction between normal material/U-pattern material), conveying speed, plate thickness, plate width, plated deposition and the like are previously determined or measured before the coils are fed into the plating step, and are input to the process computer 14.

As before, heat is supplied to the heating zone 4*a* by the combustion of a gas, and a flow rate of a fuel gas is adjusted by controlling the opening of a flow control valve by the heat input adjuster 11, which receives a set point for the heat input from the heat input calculator 13 and the compensation from the feedback compensating control system as before.

A furnace thermometer 8 is disposed inside the heating zone 4*a*, and a plate thermometer 10 which determines the plate temperature of the band steel 2 and the emissivity meter 9 which determines the emissivity of the surface of the band steel 2 are disposed at the outlet of the heated zone 4*b*, thus feeding the plate temperature Tx and the emissivity $\epsilon x$ to the compensators 16 and 15, respectively, as before.

A control over the flow rate of the gas blown by the nozzle 3 takes place in the same manner as mentioned in connection with FIG. 1. The heat input Q or the set point therefor is again calculated according to the equation (1), with the result of calculation applied to the heat adjuster 11 as mentioned previously.

Figure 5:
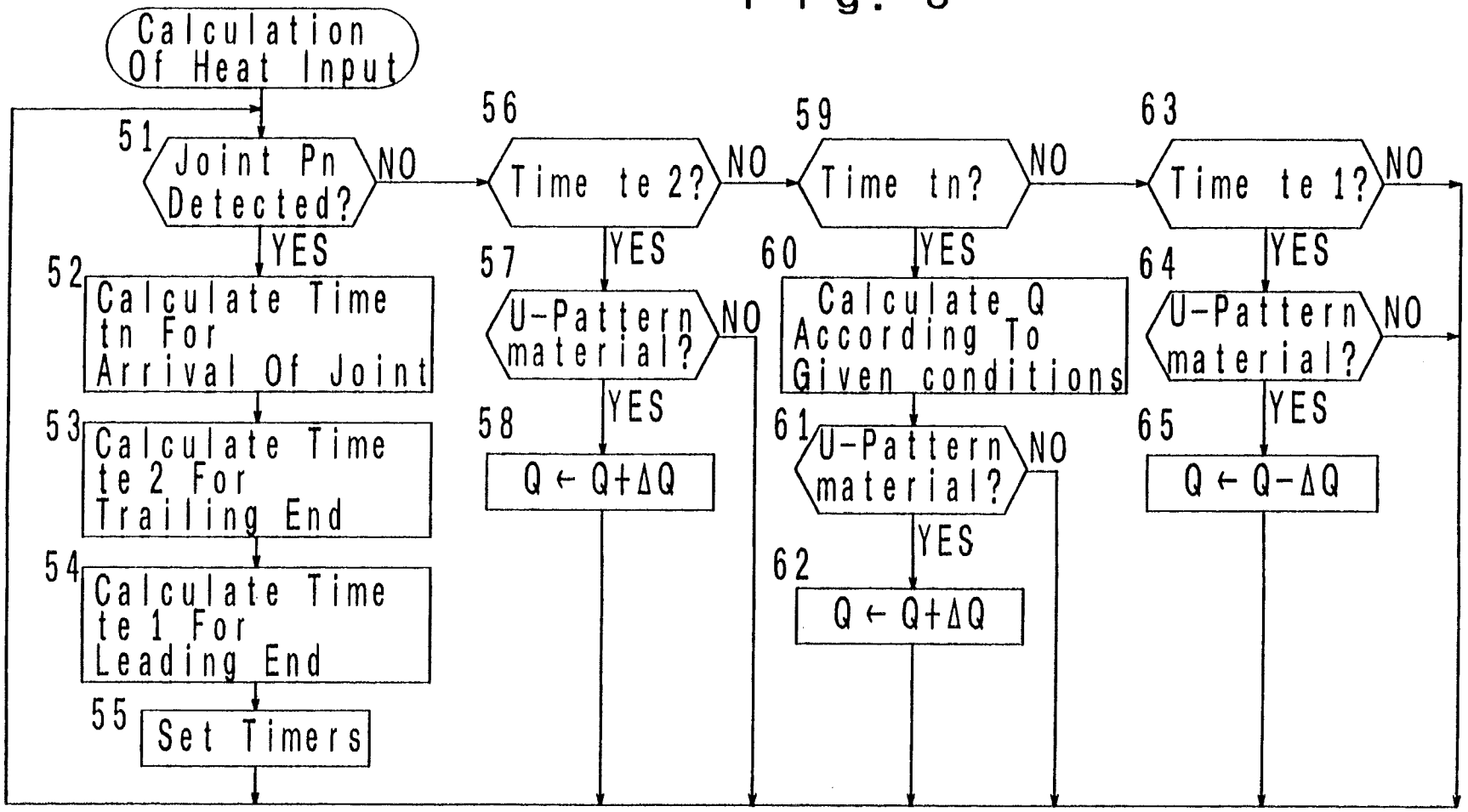
FIG. 5 is a flow chart illustrating the operation of a heat input calculator 13.
Figure 6:
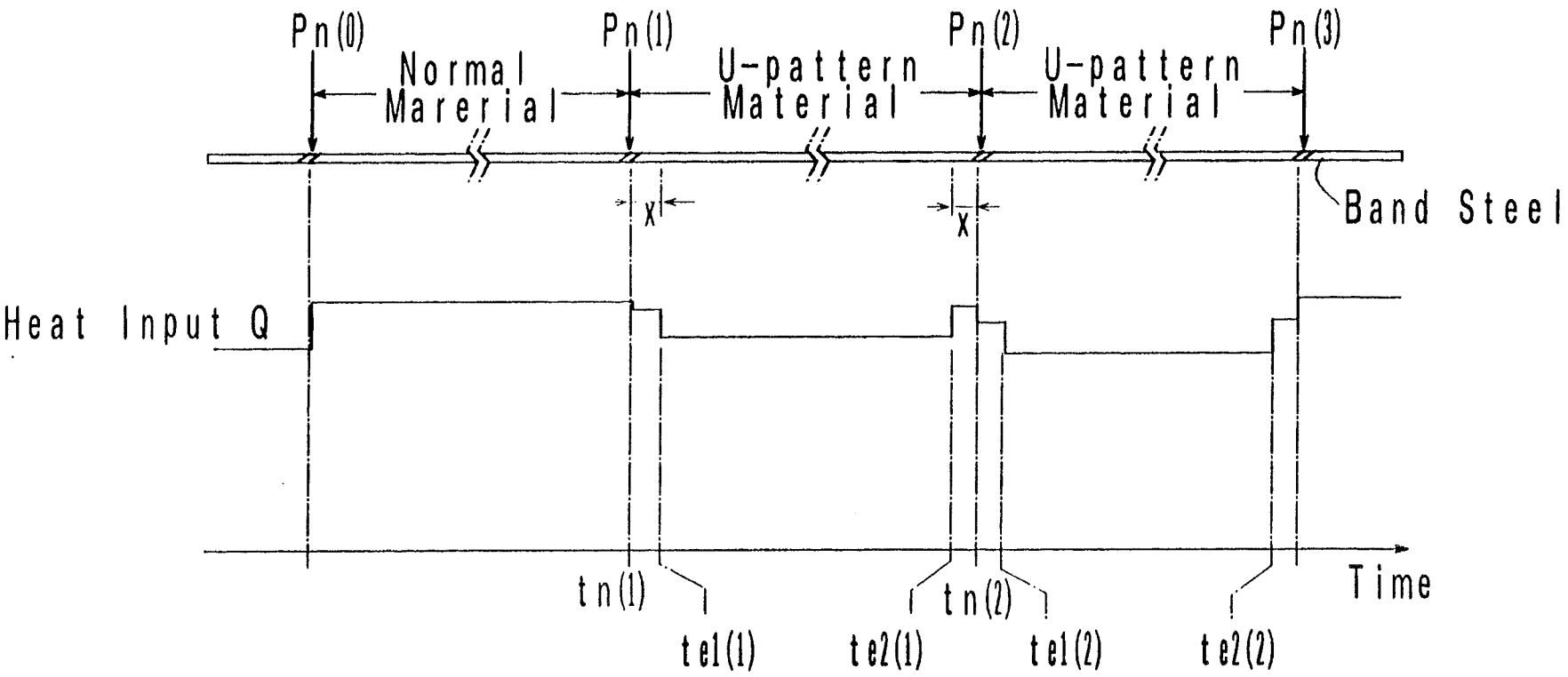
FIG. 6 is a timing chart showing an example of a change in the heat input with respect to the position of the band steel and to the time.

However, in this embodiment, the heat input calculator 13 executes a specific processing operation as indicated in FIG. 5 in order to apply a special compensation for the heat input when U-pattern material is being treated. FIG. 6 shows an example of the relationship between several points on the band steel 2, the time when such point passes through the heating zone 4*a*, and the heat input Q. The operation of the heat input calculator 13 will be specifically described with reference to FIGS. 5 and 6.

At step 51, it is determined if the joint detector 22 has detected a joint location Pn in the band steel 2. If the joint location Pn is detected, the operation continues to step 52, and otherwise the operation proceeds to step 56. At step 52, using a distance from the location of the joint detector 22 to the heating zone 4*a* and the travelling speed of the band steel 2 being passed, a time tn is determined when the detected joint location or the leading end of the next coil reaches the heating zone 4*a*.

In this embodiment, a compensation is made for a U-pattern material so that a heat input thereto in ranges having a length x from the leading and the trailing end thereof is different from the heat input to the remainder of such material. At this end, at step 53, a time te2 when a point on the material which is located by "x" short of the joint position Pn reaches the heating zone 4*a* is calculated on the basis of tn, x and the conveying speed. Similarly, at step 54, a time te1 when a point on the material which is located by "x" behind the joint position Pn reaches the heating zone 4*a* is similarly calculated on the basis of tn, x and the conveying speed.

At step 55, timers are loaded in accordance with the calculated times tn, te1 and te2, respectively, in order to enable the execution of a given operation to be described later. At time te2, the program proceeds from step 56 to step 57, and at time tn, the program proceeds from step 59 to step 60, and at time te1, the program proceeds from step 63 to step 64.

At time tn, namely, when the joint position Pn of the band steel 2 reaches the heating zone 4*a* of the alloying furnace, the calculation according to the equation (1) is performed at step 60, followed by the calculation of the heat input Q to the coil (band steel 2) which is to be subject to an alloying treatment. At next step 61, the steel variety of the next coil is examined, to see if it is or is not a U-pattern material. When it is found that the coil represents a U-pattern material, the program enters step 62 where a compensation $\Delta Q$ (a constant) is added to the heat input or the set point thereof Q which is calculated at step 60.

At time te1, namely, when a portion of the band steel 2 having a length x as measured from and located advanced from the joint position Pn reaches the heating zone 4*a* of the alloying furnace, the steel variety of the coil is examined at step 64 to see if it is or is not a U-pattern material. If it is found to be a U-pattern material, a step 65 is entered where the compensation $\Delta Q$ is subtracted from the existing heat input or set point Q.

At time te2, namely, when a point which is located behind of the joint position Pn (trailing end) of the band steel 2 by an amount corresponding to the length "x" reaches the heating zone 4*a* of the alloying furnace, the steel variety of the coil is examined at step 57 to see if it is or is not a U-pattern material. If it is found to be a U-pattern material, a step 58 is entered where the compensation $\Delta Q$ is added to the existing heat input or set point Q.

To summarize, when a normal material is being treated, the heat input Q is modified only at the joint position Pn of the band steel 2 while when treating a U-pattern material, the heat input Q is calculated at the joint position Pn of the band steel 2, but in addition, the heat input is modified to a value which is equal to the heat input calculated according to the equation (2), to which the compensation ΔQ is added for the leading end or the trailing end, each having a lengh "x" of the coil while applying the calculated heat input according to the equation (1) to the remainder of the coil.

It will be understood that when the U-pattern material is being treated, the differential temperature distributions during the rolling and the cooling step cause an insufficient heat treatment of the leading and the trailing end in the alloying furnace 4 as compared with the remainder, causing the likelihood of an unalloyed surface occurring. However, by choosing an increased magnitude of heat input to the leading and the trailing end, the occurrence of such an unalloyed surface can be prevented. Since such compensation represents a feedforward compensation depending on the location of the band steel, no time lag is caused in the compensating control.

In the present embodiment, the heat input applied to the leading and the trailing end of the U-pattern material is increased than for the remainder, but it should be understood that a reverse compensation may produce better results depending on the temperature distributions which prevail during the rolling and the cooling step, such as by reducing the heat input applied to the leading and the trailing end as compared with the remainder. In the above description, timers are used to track the leading and the trailing end, but alternatively, a pulse generator mounted on the roll 20 may be used to produce a pulse count which corresponds to such length of the both ends.

Returning to FIG. 4, the target value calculator 18 produces target values for the plate temperature and the emissivity on the basis of information which is output from the process computer 14. The target value for the plate temperature T0 is applied to the plate temperature compensator 16 while the target value for the emissivity ϵ0 is applied to the emissivity compensator 15, both for purpose of feedback control. These target values are calculated according to the equations (2) and (3), respectively.

The heat input which is calculated by the heat input calculator 13 will be slightly offset from an optimum heat input as a result of deviations between the set points and the actual values of process parameters including the furnace temperature, the plated deposition, the conveying speed, the plate width, the plate thickness and the steel variety constant and also as a result of a fluctuation in the aluminium concentration in the molten zinc bath 1. In order to compensate for such an error, in the present embodiment, the degree of alloying of the band steel 2 is measured at the outlet of the heated zone 4*b*, and such measured value is used in a feedback compensating control.

The plate temperature compensator 16 which forms part of a feedback compensating control system calculates a compensation Ct in accordance with a deviation between a target value of the plate temperature T0 and a detected value of the plate temperature (a crosswise mean value) Td, which is then output to a maximum value selector 17. The emissivity compensator 15 which also forms part of the feedback compensating control system calculates a compensation Cϵ in accordance with the deviation between the target value of emissivity ϵ0 and the detected value of emissivity (crosswise minimum value) ed, which is then output to the maximum value selector 17. The maximum value selector 17 compares the two inputs of compensations Ct and Cϵ, and selects whichever is the greater in magnitude, and applies the selected compensation through a switch SW for addition to the set point of the heat input (or target value) which is determined by the feedforward control system, to be applied to the heat input adjuster 11.

An example of operation of the feedback compensating control system is illustrated in FIG. 3. Referring to FIG. 3, the plate temperature compensation Ct is initially greater than the emissivity compensation Cϵwhereby the plate temperature compensation Ct is selected as the output from the selector 17 to serve as a compensation to the heat input, whereby the heat input is modified in a manner to reduce a deviation between the target value T0 (which is also a target value for the degree of alloying) and the detected value Td toward 0. As the emissivity compensation Cϵ increases gradually and when it exceeds in magnitude the plate temperature compensation Ct, or when the detected emissivity ed reduces below its target value ϵ0 (which is also a target value for the degree of alloying), the emissivity compensation Cϵ is selected as the compensation to the heat input, and the heat input is modified so that the detected value ed approaches the target value ϵ0.

In addition to calculating the set point for the heat input on the basis of information delivered from the process computer 14, the heat input calculator 13 also controls the opening or closing of the switch SW. The switch SW is normally closed to maintain the feedback compensation on or effective, but whenever process parameters (such as the steel variety or the plated deposition or the like) which are delivered from the process computer 14 are changed at timing when a joint between adjacent steel coils passes through the furnace, the switch SW is temporarily opened to turn the feedback compensating control off.

While in the described embodiment, the emissivity of the band steel is used as means which is used to estimate the degree of alloying of the band steel, it is theoretically possible to replace the emissivity by the reflectivity of the surface of the band steel, which is a similar parameter. When the reflectivity is used, it exhibits a high magnitude when the degree of alloying is low, and exhibits a smaller value when the degree of alloying is high. However, in actual operations, it needs to measure a temperature of the band steel at the outlet of the heated zone for a management of the operation, and it needs to measure the emissivity of the band steel for measuring the temperature of the band steel and hence the use of the emissivity is practical.

The target values T0 and ϵ0 for the plate temperature and the emissivity may be calculated according to the equations (4) and (5), respectively.

When the degree of alloying is controlled so as to maintain the lower limit thereof, the target values T0 and ϵ0 for the plate temperature and the emissivity may be replaced by constants.

The equation (1) which is used to estimate the heat input may be replaced by either one of the equations (6), (7) and (8).

In addition, in the described embodiment, the absolute magnitude of the heat input Q has been obtained. However, in actuality, the calculation of the heat input is repeatedly executed at a given period of time, and accordingly, the control may be modified so that a deviation in the heat input is repeatedly calculated instead, with a resulting deviation added to the existing heat input. In such instance, the deviation in the heat input may be calculated according to one of the equations (9) to (13).

It should be noted that various constants and compensations which are used in the individual calculating equations are preset to provide optimum result on the basis of the past operating performance of the equipment.

Third Embodiment

Figure 7:
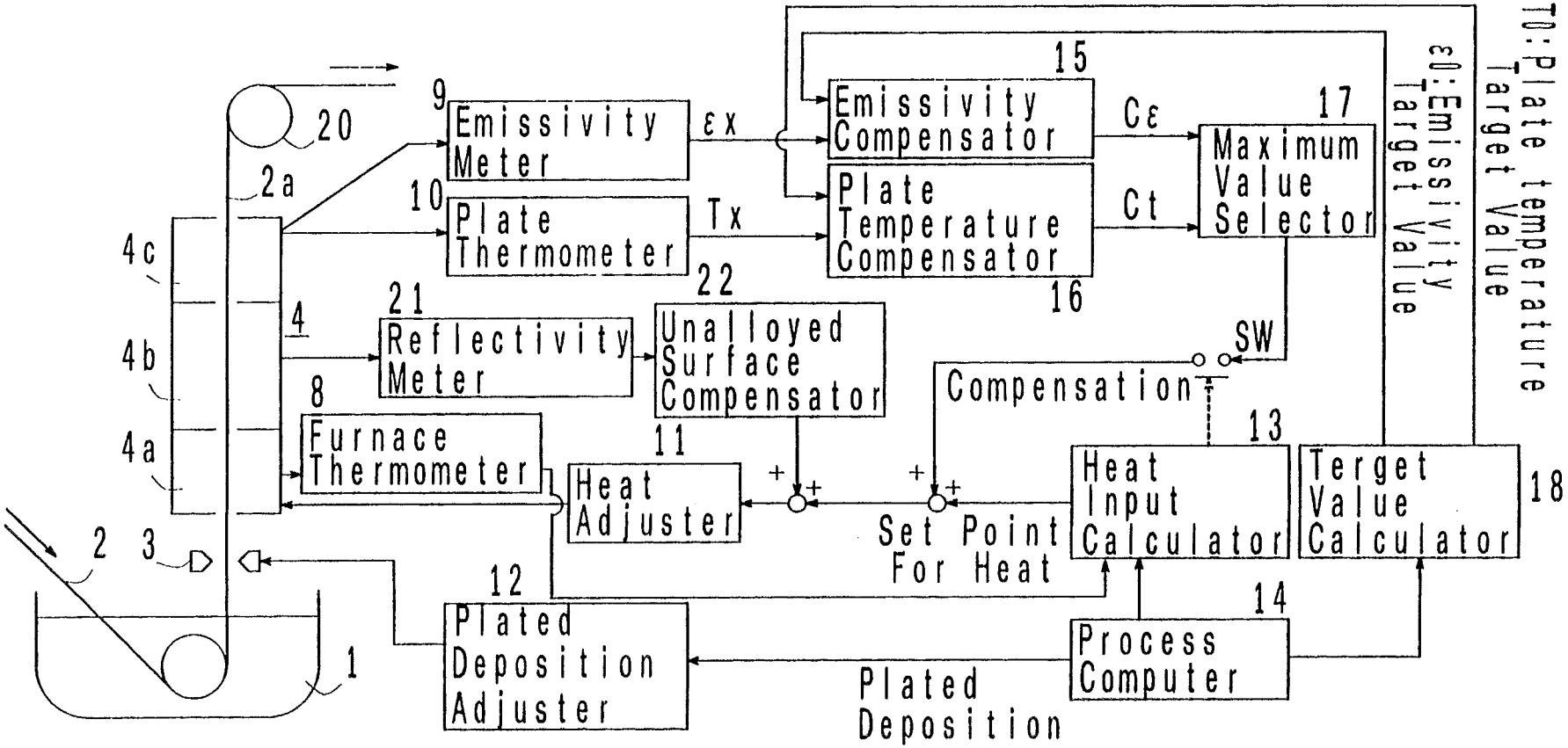
FIG. 7 is a block diagram showing an essential arrangement of a step of manufacturing a hot galvanized and alloyed band steel.

FIG. 7 shows an essential arrangement of a step of manufacturing a hot galvanized and alloyed band steel. Referring to FIG. 7, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone 4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c* to form a zinc-iron alloy plated layer having an iron content on the order of 6 to 13% near its surface. Upon exiting the furnace 4, the band steel 2 is passed around a roll 20 to be conveyed to a successive step.

In this embodiment, heat is supplied to the heating zone 4*a* of the furnace by the combustion of a gas, and the heat input to the heating zone 4*a* is controlled by controling a flow rate of a fuel gas being supplied. This control takes place by a heat adjuster 11 adjusting the opening of a flow rate control valve which is not shown. A set point of the heat input (or target value) which is delivered from a heat input calculator 13 and a compensation from a feedback compensating control system to be described later are applied to the heat adjuster 11.

A furnace thermometer 8 is disposed in the heating zone 4*a* while a reflectivity meter 21 which detects the optical reflectivity of the surface of the band steel is disposed at the outlet of the heating zone 4*a* (but within the insulated heated zone). A plate thermometer 10 which determines the plate temperature of the band steel 2 and an emissivity meter 9 which determines the emissivity of the surface of the band steel 2 are disposed at the outlet of the heated zone 4*b*. The furnace temperature which is detected by the furnace thermometer 8 is input to the heat input calculator 13 while the optical reflectivity detected by the reflectivity meter 21 is input to an unalloyed surface compensator 22. The plate temperature Tx determined by the thermometer 10 is input to the plate temperature compensator 16 while the emissivity $\epsilon x$ determined by the emissivity meter 9 is input to the emissivity compensator 15. The emissivity meter 9 depends for its operation on the conventional principle of determining the emissivity.

Figure 8:
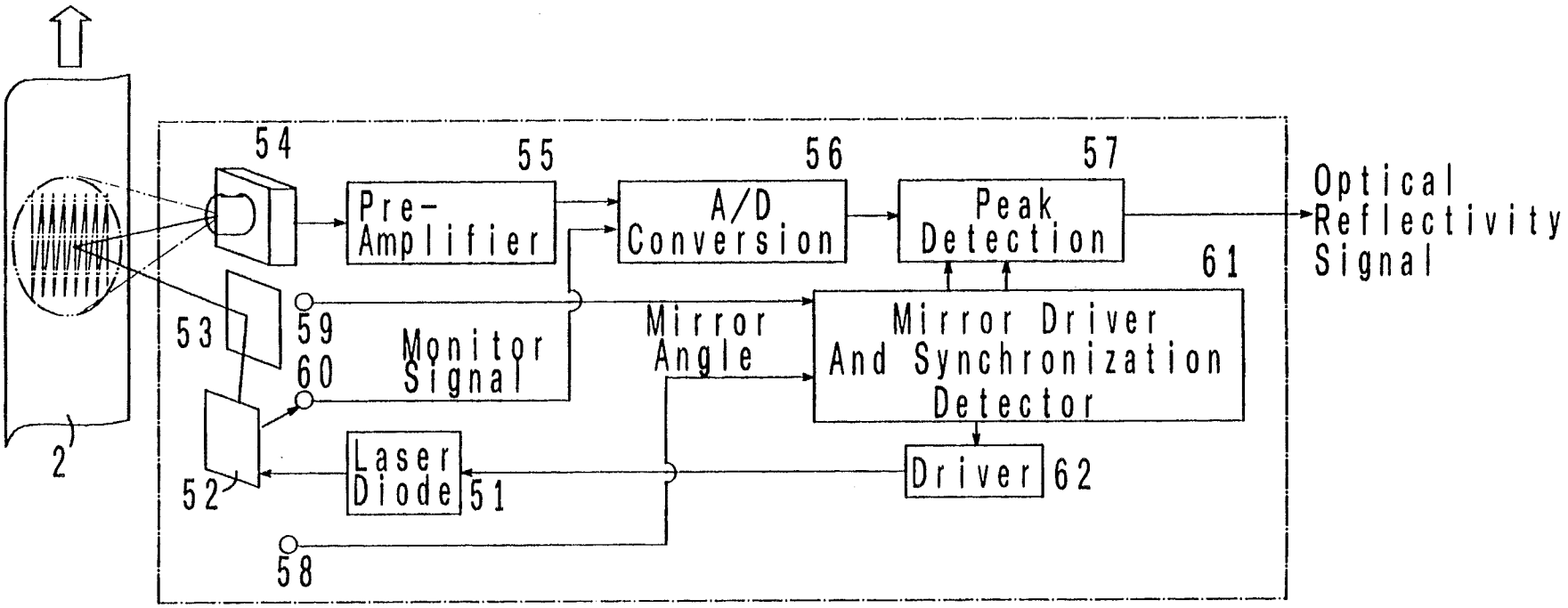
FIG. 8 is a block diagram showing the construction of a reflectivity meter 21.

The construction of the reflectivity meter 21 is shown in FIG. 8. Referring to FIG. 8, a laser diode 51 emits laser radiation which is reflected by a longitudinally oscillating mirror 52 and a transversely oscillating mirror 53 to impinge upon the surface of the band steel 2, the reflection from which is incident upon a light receiver 54. Each of the mirrors 52 and 53 is driven for rocking motion in the longitudinal and the transverse direction, respectively, thus normally scanning the incident position of the laser radiation upon the band steel in both longitudinal and transverse directions. If an arrangement is made to fix the incident position of the laser radiation so that a reflection from a normal reflecting point on the surface of the band steel impinges upon the receiver 54, longitudinal and transverse oscillations which occur in the band steel 2 causes the reflection which impinges upon the receiver 54 to deviate from the normal reflecting point. Accoridngly, by scanning the laser radiation across a surface, it is assured that a reflection from the normal reflecting point never fails to impinge upon the receiver 54 within the scan range. In this manner, a peak value of the intensity of the incident radiation corresponds to the intensity of reflection from the normal reflecting point. The receiver 54 produces a signal which represents the level of light detected thereby, and such signal is applied to a preamplifier 55, and thence to an A/D converter 56 where the signal is converted into a digital value, which is then applied to a peak detector 57. The detector 57 maintains a peak value across a scan area, and such peak value is output as an optical reflectivity signal.

The description will be continued with reference to FIG. 7.

The flow rate of the gas which is blown from the nozzles 3 is controlled by a plated deposition adjuster 12, which responds to a set point of the plated deposition supplied as an input, by controlling the flow rate of the gas being supplied to the nozzles 3. A process computer 14 controls the entire step of manufacturing a hot galvanized and alloyed band steel. It delivers a set point for the plated deposition to a plated deposition adjuster 12, delivers information including the plated deposition, the steel variety, the conveying speed, the plate width and the plate thickness to the heat input calculator 13, and also delivers information including the plated deposition, the steel variety and the conveying speed to a target value calculator 18. In response to the furnace temperature which is inputted and information supplied including the plated deposition, the steel variety, the conveying speed, the plate width and the plate thickness, the heat input calculator 13 calculates the heat input Q, which is a set point for the heat input, according to the equation (1) shown above, and applies the result of calculation to the heat adjuster 11.

The target value calculator 18 determines target values for the plate temperature and the emissivity on the basis of information which is delivered from the process computer 14. A target value T0 for the plate temperature is applied to a plate temperature compensator 16 while a target value $\epsilon 0$ for the emissivity is applied to an emissivity compensator 15, both of which are utilized for purpose of feedback control. These target values are calculated according to the equations (2) and (3).

The heat input which is calculated by the heat input calculator 13 will be slightly offset from an optimum heat input as a result of deviations between the set points and the actual values of process parameters including the furnace temperature, the plated deposition, the conveying speed, the plate width, the plate thickness and the steel variety constant and also as a result of a fluctuation in the aluminium concentration in the molten zinc bath 1. In order to compensate for such an error, in the present embodiment, the degree of alloying of the band steel 2 is measured at the outlet of the heated zone 4*b*, and such measured value is used in a feedback compensating control. To allow an unalloyed surface which occurs sporadically to be compensated for rapidly, a feedback control is applied whenever the occurrence of an unalloyed surface or an insufficient degree of alloying is detected by the reflectivity meter 21 at the outlet of the heating zone 4*a* in terms of the optical reflectivity of the surface of the band steel, by causing an unalloying surface compensator 22 to provide a compensation for the heat input.

The plate temperature compensator 16 which forms part of a feedback compensating control system calculates a compensation Ct in accordance with a deviation between a target value of the plate temperature T0 and a detected value of the plate temperature (a crosswise mean value) Td, which is then output to a maximum value selector 17. The emissivity compensator 15 which also forms part of the feedback compensating control system calculates a compensation Cϵ in accordance with the deviation between the target value of emissivity ϵ0 and the detected value of emissivity (crosswise minimum value) ϵd, which is then output to the maximum value selector 17. The maximum value selector 17 compares the two inputs of compensations Ct and Cϵ, and selects whichever is the greater in magnitude, and applies the selected compensation through a switch SW for addition to the set point of the heat input (or target value) which is determined by the feedforward control system, to be applied to the heat input adjuster 11.

An example of operation of the feedback compensating control system is illustrated in FIG. 3. Referring to FIG. 3, the plate temperature compensation Ct is initially greater than the emissivity compensation Cϵ, whereby the plate temperature compensation Ct is selected as the output from the selector 17 to serve as a compensation to the heat input, whereby the heat input is modified in a manner to reduce a deviation between the target value T0 (which is also a target value for the degree of alloying) and the detected value Td toward 0. As the emissivity compensation Cϵ increases gradually and when it exceeds in magnitude the plate temperature compensation Ct, or when the detected emissivity ed reduces below its target value ϵ0 (which is also a target value for the degree of alloying), the emissivity compensation Cϵ is selected as the compensation to the heat input, and the heat input is modified so that the detected value ed approaches the target value ϵ0.

In addition to calculating the set point for the heat input on the basis of information delivered from the process computer 14, the heat input calculator 13 also controls the opening or closing of the switch SW. The switch SW is normally closed to maintain the feedback compensation on or effective, but whenever process parameters (such as the steel variety or the plated deposition or the like) which are delivered from the process computer 14 are changed at timing when a joint between adjacent steel coils passes through the furnace, the switch SW is temporarily opened to turn the feedback compensating control off.

Figure 9:
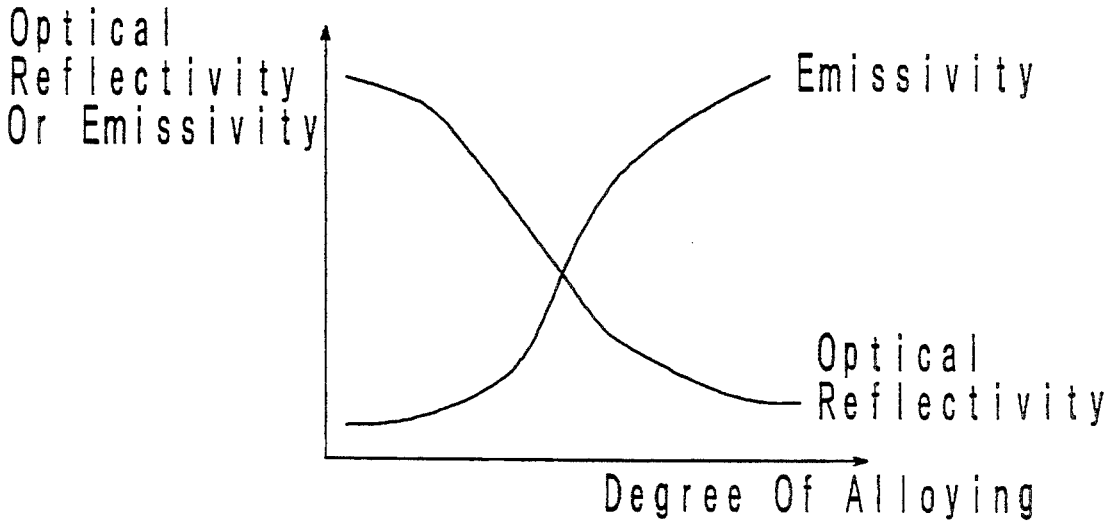
FIG. 9 graphically shows a correlation between the optical reflectivity, the emissivity and the degree of alloying.

As shown in FIG. 9, the optical reflectivity has a close correlation with the degree of alloying in a similar manner as the optical reflectivity. Accordingly, it is possible to estimate the degree of alloying at the outlet of the heating zone in terms of the optical reflectivity detected by the reflectivity meter 21. However, the degree of alloying cannot be accurately detected at the outlet of the heating zone, and accordingly, the detected optical reflectivity is utilized for providing a rapid compensating control for an unalloyed surface which occurs sporadically.

Figure 10:
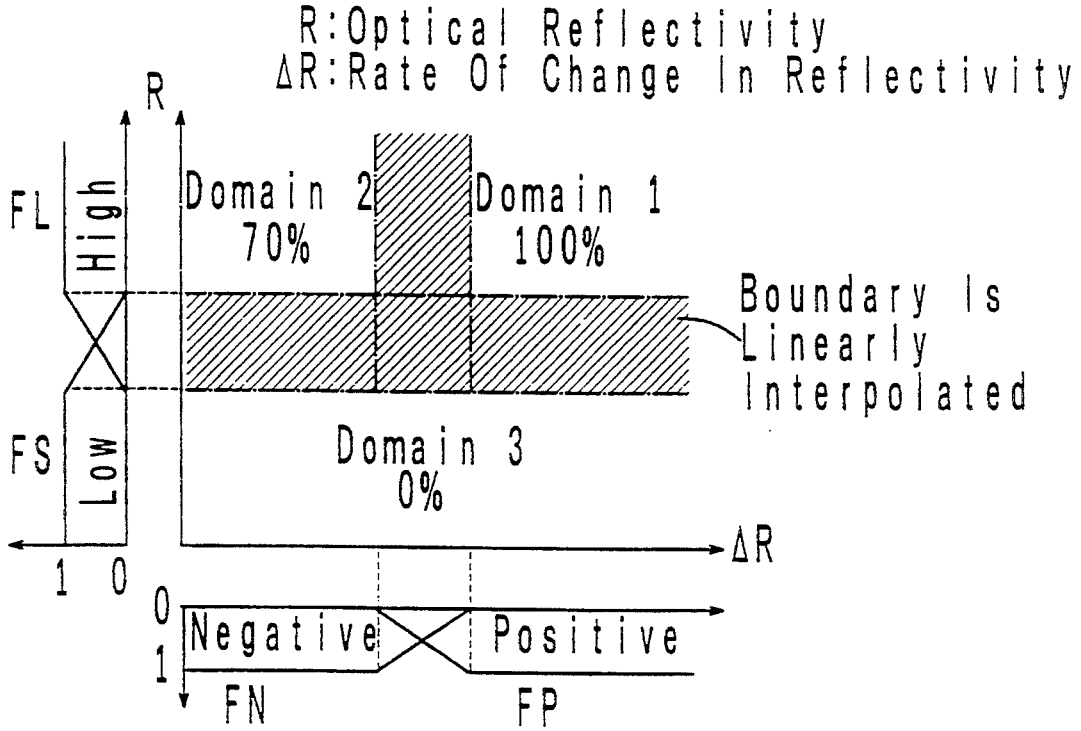
FIG. 10 graphically shows a relation between a compensation rate and the division of domains in accordance with R and ΔR for the unalloyed surface compensator 22.

In the unalloyed surface compensator 22 of the present embodiment, a total compensation is determined on the basis of a reference compensation which is a constant, and to which a compensation rate which differs for each domain shown in FIG. 10 is applied. Referring to FIG. 10, a two dimensional space defined by the detected optical reflectivity R and a rate of change thereof AR is divided into three domains, domain 1, domain 2 and domain 3. A boundary between these domains is not clearly defined, and is shown hatched. A linear interpolation using functions FN, FP, FL and FS are applied to such boundary region. In the present example, the compensation rate for domain 1 is chosen to be 100%, the compensation rate for domain 2 70% and the compensation rate for domain 3 0%, respectively.

By way of example, when the optical reflectivity R is high (FL=1) and the rate of change ΔR is positive (FP=1), 40 $Nm^3$/hour is output as a compensation from the unalloyed surface compensator 22. When the optical reflectivity R is high (FL=1) and the rate of change ΔR is negative (FN=1), 28 $Nm^3$/hour is output as a compensation from the compensator 22. When the optical reflectivity R is small (FS=1), the compensation is equal to zero.

In this embodiment, a control period of the unalloyed surface compensator 22 or the period with which the compensation which is output from the compensator 22 is updated is chosen to be longer than a time interval required for the band steel 2 to pass from the inlet of the heating zone 4*a* to the location where the reflectivity meter 21 detects the optical reflectivity.

In the above embodiment, a reference compensation used in the unalloyed surface compensator 22 is chosen to be a constant, but the reference compensation may be variable as a function of the conveying speed, the steel variety, the plated deposition or the like which is output from the process computer 14, for example, so as to be determined by using a formula or a look-up table.

In this embodiment, the emissivity of the band steel is used as means for estimating the degree of alloying of the band steel at the outlet of the heated zone, it may be replaced by the optical reflectivity. In this case, the same reflectivity meter 21 may be used for such a sensor.

The target values TO and ϵ0 for the plate temperature and the emissivity may be calculated according to the equations (4) and (5) rather than according to the equations (2) and (3) mentioned above.

Where the degree of alloying is controlled to maintain the lower limit, the target values T0 and ϵ0 for the plate temperature and the emissivity may be replaced by constants.

The heat input may be estimated according to one of the equations (6), (7) and (8) instead of the equation (1).

In the above embodiment, the absolute magnitude of the heat input Q has been obtained, but in actuality, the calculation of the heat input is repeatedly executed at a given period of time, and hence the control may be modified by repeatedly calculating a deviation of the heat input, and adding the resulting deviation to the existing heat input. In such instance, the deviation may be calculated according to one of the equations (9) to (13).

Fourth Embodiment

Figure 11:
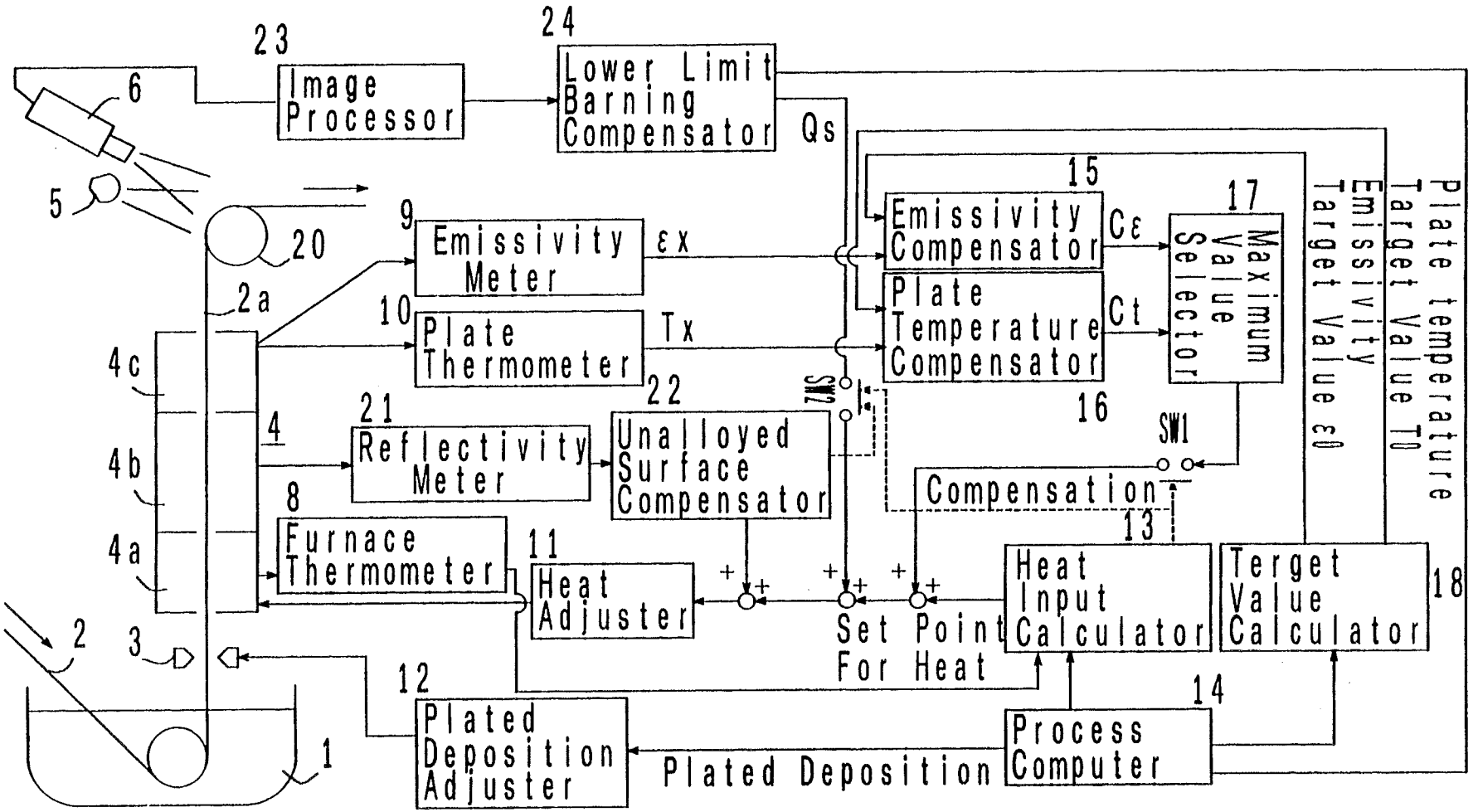
FIG. 11 is a block diagram showing an essential arrangement of a step for manufacturing a hot galvanized and alloyed band steel.

FIG. 11 shows an essential arrangement of a step of manufacturing a hot galvanized and alloyed band steel. Referring to FIG. 11, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone 4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c* to form a zinc-iron alloy plated layer having an iron content on the order of 6 to 13% near its surface. Upon exiting the furnace 4, the band steel 2 is passed around a roll 20 to be conveyed to a successive step.

In this embodiment, heat is supplied to the heating zone 4*a* of the furnace by the combustion of a gas, and the heat input to the heating zone 4*a* is controlled by controling a flow rate of a fuel gas being supplied. This control takes place by a heat adjuster 11 adjusting the opening of a flow rate control valve which is not shown. A set point of the heat input (or target value) which is delivered from a heat input calculator 13 and a compensation from a feedback compensating control system to be described later are applied to the heat adjuster 11.

A furnace thermometer 8 is disposed in the heating zone 4*a*, a reflectivity meter 21 which detects the optical reflectivity of the surface of the band steel is disposed at the outlet of the heating zone 4*a* (but within the heated zone), and a plate thermometer 10 which determines the plate temperature of the band steel 2 and an emissivity meter 9 which determines the emissivity of the surface of the band steel 2 are disposed at the outlet of the heated zone 4*b*. The furance temperature detected by the thermometer 8 is input to the heat input calculator 13, the optical reflectivity detected by the reflectivity meter 21 is input to the unalloyed surface compensator 22, the plate temperature Tx determined by the thermometer 10 is input to the plate temperature compensator 16, and the emissivity $\epsilon x$ determined by the emissivity meter 9 is input to the emissivity compensator 15. The emissivity meter 9 operates on a known priniple of determining an emissivity. In order to determine the degree of alloying of the band steel 2*a* which has been subjected to the alloying treatment, an illumination unit 5 and ITV camera 6 are disposed adjacent to the roll 20 located at the outside of the alloying furnace 4 with their optical axes directed toward the band steel disposed on the roll 20.

The arrangement of the reflectivity meter 21 remains the same as that shown in FIG. 4, and therefore will not be described.

The description will be continued with reference to FIG. 11. The flow rate of the gas which is blown from the nozzles 3 is controlled by a plated deposition adjuster 12, which responds to a set point of the plated deposition supplied as an input, by controlling the flow rate of the gas being supplied to the nozzles 3. A process computer 14 controls the entire step of manufacturing a hot galvanized and alloyed band steel. It delivers a set point for the plated deposition to a plated deposition adjuster 12, delivers information including the plated deposition, the steel variety, the conveying speed, the plate width and the plate thickness to the heat input calculator 13, and also delivers information including the plated deposition, the steel variety and the conveying speed to a target value calculator 18. In response to the furnace temperature which is inputted and information supplied including the plated deposition, the steel variety, the conveying speed, the plate width and the plate thickness, the heat input calculator 13 calculates the heat input Q, which is a set point for the heat input, according to the equation (1) shown above, and applies the result of calculation to the heat adjuster 11.

The heat input which is calculated by the heat input calculator 13 will be slightly offset from an optimum heat input as a result of deviations between the set points and the actual values of process parameters including the furnace temperature, the plated deposition, the conveying speed, the plate width, the plate thickness and the steel variety constant and also as a result of a fluctuation in the aluminium concentration in the molten zinc bath 1. In order to compensate for such an error, in the present embodiment, the degree of alloying of the band steel 2 is measured at the outlet of the heated zone 4*b*, and such measured value is used in a feedback compensating control. To allow an unalloyed surface which occurs sporadically to be compensated for rapidly, a feedback control is applied whenever the occurrence of an unalloyed surface or an insufficient degree of alloying is detected by the reflectivity meter 21 at the outlet of the heating zone 4*a* in terms of the optical reflectivity of the surface of the band steel, by causing an unalloying surface compensator 22 to provide a compensation for the heat input.

The plate temperature compensator 16 which forms part of a feedback compensating control system calculates a compensation Ct in accordance with a deviation between a target value of the plate temperature T0 and a detected value of the plate temperature (a crosswise mean value) Td, which is then output to a maximum value selector 17. The emissivity compensator 15 which also forms part of the feedback compensating control system calculates a compensation $C\epsilon$ in accordance with the deviation between the target value of emissivity $\epsilon 0$ and the detected value of emissivity (crosswise minimum value) $\epsilon d$, which is then output to the maximum value selector 17. The maximum value selector 17 compares the two inputs of compensations Ct and $C\epsilon$, and selects whichever is the greater in magnitude, and applies the selected compensation through a switch SW1 for addition to the set point of the heat input (or target value) which is determined by the feedforward control system, to be applied to the heat input adjuster 11.

An example of operation of the feedback compensating control system is illustrated in FIG. 3. Referring to FIG. 3, the plate temperature compensation Ct is initially greater than the emissivity compensation $C\epsilon$, whereby the plate temperature compensation Ct is selected as the output from the selector 17 to serve as a compensation to the heat input, whereby the heat input is modified in a manner to reduce a deviation between the target value T0 (which is also a target value for the degree of alloying) and the detected value Td toward 0.

As the emissivity compensation Cϵ increases gradually and when it exceeds in magnitude the plate temperature compensation Ct, or when the detected emissivity ed reduces below its target value ϵ0 (which is also a target value for the degree of alloying), the emissivity compensation Cϵ is selected as the compensation to the heat input, and the heat input is modified so that the detected value ed approaches the target value ϵ0.

In addition to calculating the set point for the heat input on the basis of information delivered from the process computer 14, the heat input calculator 13 also controls the opening or closing of the switches SW1 and SW2. The switches SW1 and SW2 is normally closed to maintain the feedback compensation on or effective, but whenever process parameters (such as the steel variety or the plated deposition or the like) which are delivered from the process computer 14 are changed at timing when a joint between adjacent steel coils passes through the furnace, the switches SW1 and SW2 are temporarily opened to turn the feedback compensating control off.

As shown in FIG. 9, the optical reflectivity has a close correlation with the degree of alloying as is the emissivity. Accordingly, it is possible to estimate the degree of alloying at the outlet of the heating zone in terms of the optical reflectivity detected by the reflectivity meter 21. However, it is impossible to detect the degree of alloying accurately at the outlet of the heating zone, and hence the optical reflectivity detected is utilized to provide a rapid compensating control for the unalloying which occurs sporadically.

In the unalloyed surface compensator 22 of this embodiment, a reference compensation is provided as a constant, and a total compensation is determined on the basis of the constant and compensation rates for individual domains shown in FIG. 10.

In this embodiment, a control period of the unalloying compensator 22, namely, a period of time with which the total compensation which is output from the unalloying compensator 22 is updated is chosen longer than the length of time required for the band steel 2 to pass from the inlet of the heating zone 4*a* to the location where the detection by the reflectivity meter 21 occurs.

While the reference compensation used in the unalloying compensator 22 of this embodiment is chosen to be a constant, it may be made variable as a function of the conveying speed, the steel variety, the plated deposition or the like which are output from the process computer 14, for example, deriving it by using an arithmetic formula or table look-up.

The illumination unit 5 disposed at the outlet side of the alloying furnace 4 irradiates the band steel 2 with normal visible light while ITV camera 6 takes a picture using visible light. Since there is a correlation between the optical reflectivity of the band steel 2*a* and the degree of alloying as illustrated in FIG. 9, the degree of alloying at the outlet of the alloying furnace is detected in this embodiment on the basis of the optical reflectivity of the surface of the band steel 2*a*. In actuality, such detection reveals the presence or absence of an unalloyed surface which appears spotwise.

Figure 13:
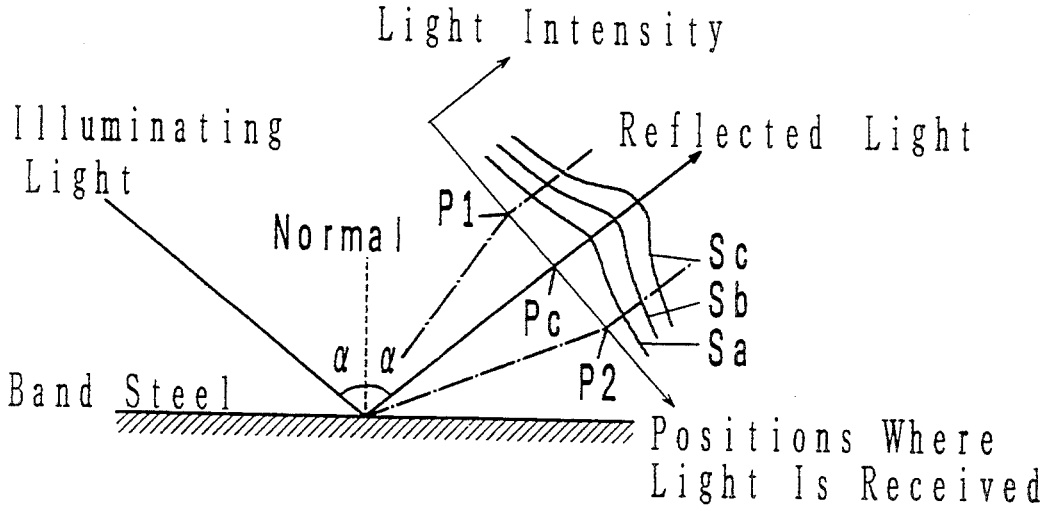
FIG. 13 graphically shows an intensity distribution of reflected light.
Figure 13:
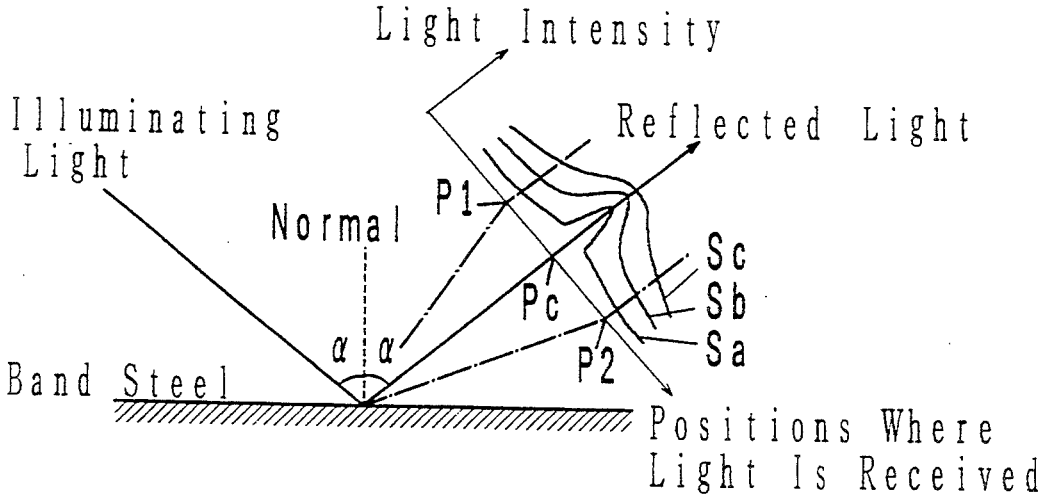

FIG. 13(*a*) illustrates different distributions of intensities of light received for three samples Sa, Sb and Sc which exhibit different degrees of alloying, namely, a high level of alloying, a medium level of alloying and a low level of alloying or very close to unalloying. It will be seen that the intensity of light received increases as the degree of alloying approaches the unalloying.

In this embodiment, a picture is taken of the band steel 2*a* as it is coiled around the roll 20. Accordingly, the band steel presents a curved surface at the location where its picture is taken, causing a large change in the angles of incidence and reflection of the irradiating light depending upon the location upon the roll 20. In other words, as viewed on the picture which is taken by ITV camera 6, a region defining the normal reflecting point therein is narrow, allowing a boundary between the normal reflecting point and the rest to appear clearly.

Figure 14:
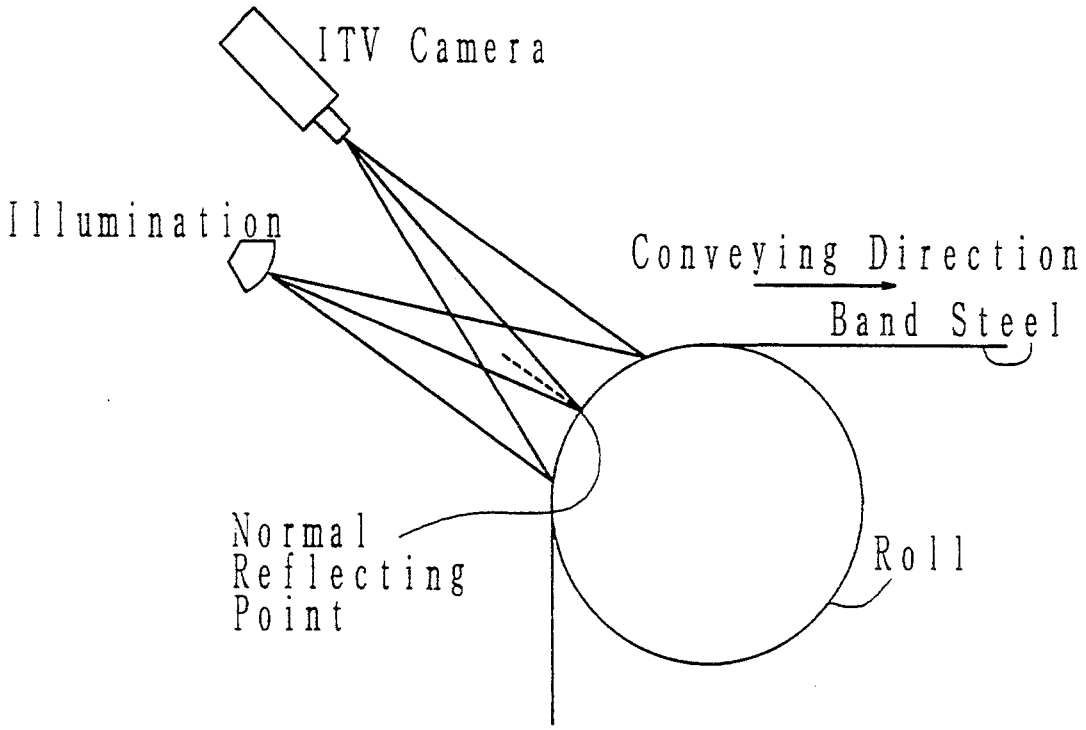
FIG. 14 is a front view showing the positional relationship between an illumination unit and ITV camera.
Figure 15:
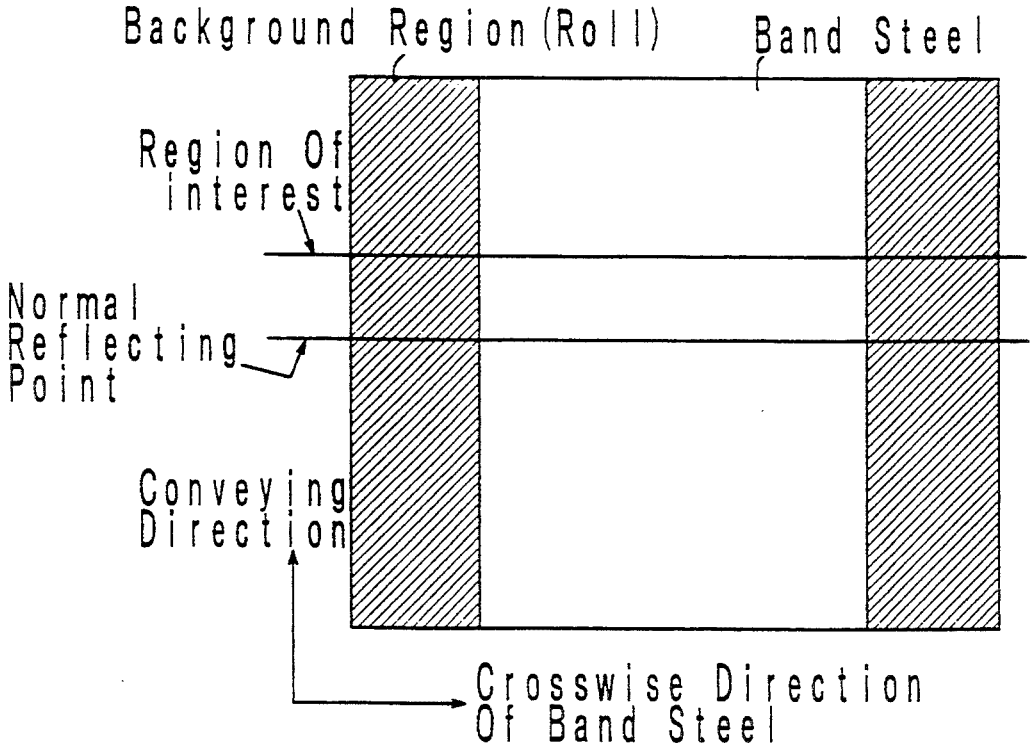
FIG. 15 is a front view showing an example of an image photographed by ITV camera.
Figure 16:
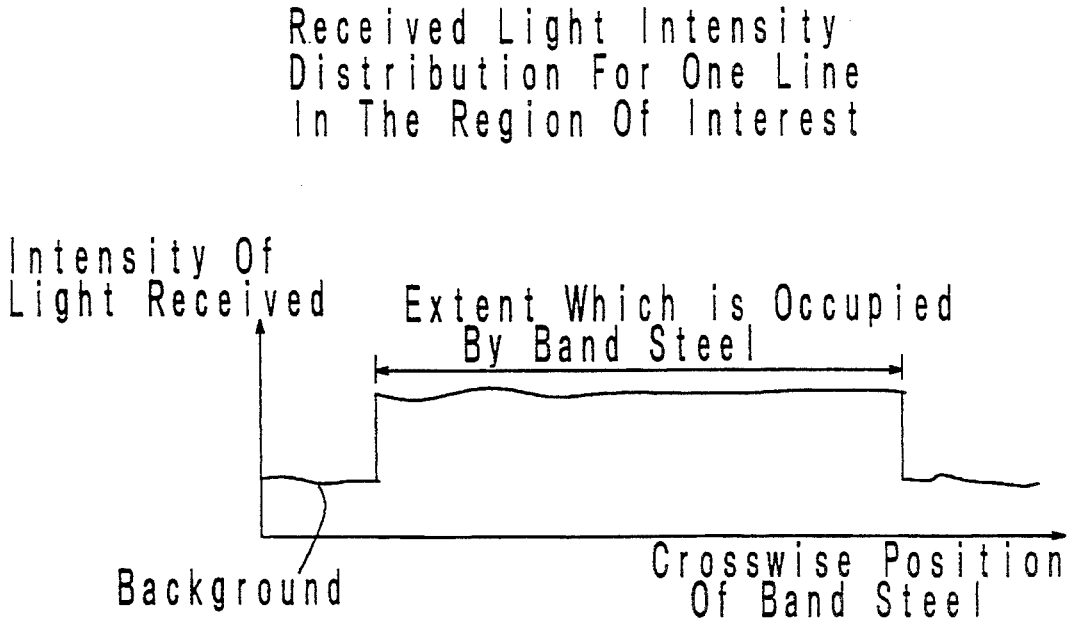
FIG. 16 is a waveform diagram for one scan line of a picture signal.

As shown in FIG. 14, an extent for which a picture is taken by ITV camera 6 contains the normal reflecting point, but in the present embodiment, a location (such as P1, P2, for example) which is displaced from the normal reflecting point Pc is chosen as a region of interest so that the intensity of light received at a location other than the normal reflecting point may be detected. An example of the entire image is shown in FIG. 15 where it will be noted that a region of interest is chosen at a location slightly offset from the normal reflecting point shown in the picture.

As shown in FIG. 11, a monochromatic picture signal (composite video signal) which is output from ITV camera 6 is input to an image processor 23 in order to determine the presence or absence of the unalloying, with its result being applied to a lower limit burning compensator 24. The construction of the image processor 23 is shown in FIG. 12.

Figure 12:
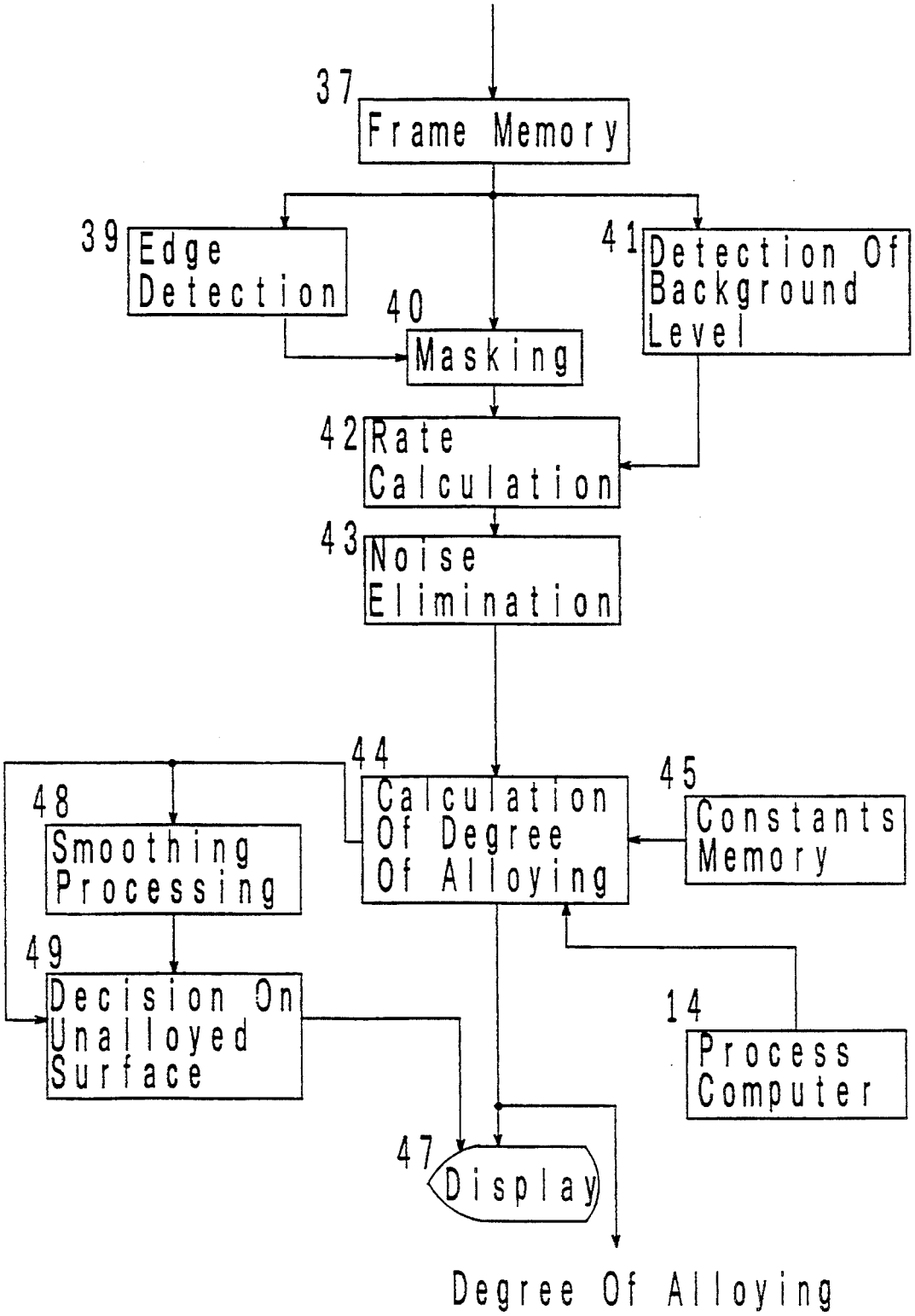
FIG. 12 is a block diagram showing the construction of an image processor 23.

Referring to FIG. 12, the monochromatic picture signal which is output from the ITV camera 6 is input to a frame memory 37 in which an image field is divided into 256 sections both vertically and horizontally, and the brightness signal level (the intensity of light received) in each picture element is converted into a digital quantity in 64 gradations (hereafter referred to as brightness information), which information is stored into the memory at an address corresponding to the location of the respective picture elements. In the description to follow, the vertical position of picture element is represented by y and the horizontal position of the element is represented by x.

An edge detector 39 reads one line of brightness information from the frame memory 7, detecting the positions of the both edges of the band steel. Specifically, values of "x" where brightness information d(x) assumes a maximum and a minimum value is searched for, and such value of x as corrected by a safety margin is used to define a left and a right edge.

$$d(x)=p(x)+2p(x+1)-2p(x+2)-p(x+3) \quad (14)$$

where p(x) represents brightness level of a picture element located at a position x, p(x+1) represents the brightness level of a picture element located at a position (x+1), p(x+2) represents the brightness level of a picture element located at a position (x+2) and p(x+3) represents the brightness level of a picture element located at a position (x+3).

A masking processor 40 masks brightness information for respective picture elements other than those located within the region of interest, excluding them from the subject of the processing operation. The region of interest is defined by a rectangle (inclusive of the boundary) having four points (x1, y1), (x2, y1), (x2, y2) and (x1, y2) as corners. The lateral positions x1 and x2 of this region represents the positions for the left and the right edge which are output from the edge detector 39. The vertical positions y1 and y2 are predetermined fixed positions. In actuality, $|y1-y2|=3$, thus choosing the number of elements located vertically within the region of interest to be equal to 4. It is to be noted that the vertical extent of the region of interest corresponds to the region of interest shown in FIG. 15.

A background level detector 41 calculates a reference brightness, by referring to the brightness information of a background area (such as roll; see FIG. 15) other than the band steel appearing on the picture. The reference brightness is not influenced by the steel variety, the conveying speed, the temperature of the band steel or the like. In this embodiment, the brightness of the illumination varies with the lateral position x, and accordingly taking such variation into consideration, the reference brightness R(x) at the position x is expressed as a linear function $R(x)=A+B\ x$ with the coefficients A and B being determined by the following approximation method of least square:

$$\begin{bmatrix} A \\ B \end{bmatrix} = \begin{bmatrix} \Sigma xi^2 & \Sigma xi \\ \Sigma xi & n \end{bmatrix}^{-1} \begin{bmatrix} \Sigma p\ (xi,\ yi) \\ \Sigma xi\ p\ (xi,\ yi) \end{bmatrix} \tag{15}$$

where $\Sigma$: $\sum_{i=1}^{n}$ $xi$: $x$ position of i-th reference point $yi$: $y$ position of i-th reference point In this example, the number of reference points n (predetermined points within the background area) is chosen equal to 10, and accordingly the reference brightness R(x) is determined on the basis of the brightness p(xi, yi) of ten reference points.

A rate calculator 42 calculates a rate of q1(x, y) of individual brightness information within the region of interest which is output from the masking processor 10 to the reference brightness R(x) which is output from the background level detector 41 according to the following equation:

$$q1(x,\ y)=p(x,\ y)/R(x) \tag{16}$$

The level of brightness information in the region of the band steel depends, in addition to the optical reflectivity of the surface of the band steel, on a fluctuation of the intensity of extraneous light, a voltage fluctuation of a power supply for the illumination source, aging effects of the illumination unit and the responses of light receiving sensors and the like. Accordingly, on the basis of a ratio of the intensity of reflected light from the band steel to the intensity of reflected light from the background area other than the band steel, an estimate of the degree of alloying is made, thus preventing fluctuations or variations of factors other than the actual optical reflectivity from influencing upon the determination of the degree of alloying.

In other words, by employing a coefficient K which integrates the effects of a fluctuation in the intensity of extraneous light, a voltage fluctuation of the power supply for the illumination source, the aging effects of the illumination unit and the responses of light receiving sensors and the like, the influence of the coefficient K can be removed from the relative brightness level. Specifically, representing the reflectivity and the brightness level at a particular point of interest on the band steel by $\epsilon$ and B, respectively, and representing the reflectivity and the brightness level of a reference point (background) by $\epsilon r$ and Br, respectively, it follows that the relative brightness level or the ratio B/Br is equal to $\epsilon/\epsilon r$, assuming that the equalities $B=K\cdot\epsilon$ and $Br=K\cdot\epsilon r$ apply.

The brightness ratio q1(x,y) at the position of each picture element which is output from the rate calculator 42 is input to a noise remover 43, which initially extracts a maximum value q2(x) among vertically aligned four picture elements according to the equation (17) indicated below. This is a processing operation which is used to detect any bright portion sensitively which results from the occurrence of the unalloying. The operation of the edge detector 39 may become unstable, whereby the detected edge may miss the surface of the band steel. In such instance, the brightness of the edge will be extremely high, causing a malfunctioning. In order to remove such abnormal brightness information and noises, the noise remover 43 extracts the smaller one of the brightness ratios of laterally adjacent two picture elements according to the equation (18) indicated below. Accordingly, when one picture element appears especially bright, it is recognized as a noise and will be neglected.

$$q2(x) = \max Y\,[q1(x,y)] \quad y1 \leqq y \leqq y2 \tag{17}$$

$$q(x) = \min\,[q2(x),\ q2(x+1)] \tag{18}$$

max $Y$ [ ]: a maximum value of [ ] in the $y$ direction min [ ]: aminimum value of [ ]

A degree of alloying calculator 44 receives the brightness ratio q(x) which is output from the noise remover 43, and calculates a degree of alloying G according to the equations (19) to (21) indicated below. The correlation between the optical reflectivity and the degree of alloying as illustrated in FIG. 9 varies greatly with the steel variety (including the nature of the surface) of the band steel, and accordingly steel variety information M (including the nature of the surface) of the band steel being currently treated which is output from the process computer 14 controlling the operation is fed to the calculator 44 while simultaneously feeding steel variety constants C1( ) and C2( ) which are previously stored in a constants memory 45 as a database and which are retrieved by the steel variety information M for calculating the degree of alloying.

$$G1 = \max X\,[q(x)] \quad x1 \leqq x \leqq x2 \tag{19}$$

$$G = 0 \quad \text{If } G1 \leqq C1(M) \tag{20}$$

$$G = C2(M)\cdot(G1 - C1(M)) \quad \text{If } G1 > C1(M) \tag{21}$$

max $X$ [ ]: a maximum value of [ ] in the $x$ direction

The degree of alloying G calculated by the calculator 44 is numerically displayed on a display 47.

In the present embodiment, the occurrence of an unalloyed surface is detected by examining the presence or absence of any rapid increase in the brightness ratio q(x) from picture element to picture element. At this end, a smoothing processor 48 smoothes out a variation of the brightness ratio q(x) with time to produce a smoothed brightness ratio, which is used as a reference level.

In practice, a smoothed brightness ratio Ga is obtained by processing a brightness ratio G1, or the output of the equation (15), at a particular point, with a first-order IIR modified digital low pass filter which is represented by the equation (22) or (23) indicated below.

$$Ga = Af\,Ga1 + (1 - Af)\,G1 \quad \text{for } G1 \leqq Ga1 \tag{22}$$

$$Ga = Ar\,Ga1 + (1 - Ar)\,G1 \quad \text{for } G1 > Ga1 \tag{23}$$

Af, Ar: filter constants (Af<Ar)
Gal: Ga calculated during the previous pass

In this example, the constants which determine the time constant of the filter is assumed such that Af<Ar, so that the smoothed brightness ratio or received light intensity ratio Ga exhibits a relatively gentle rising change (meaning a large time constant), but has a relatively rapid falling change (meaning a small time constant). If the time constant is equal for the rising and the falling portion, the smoothed received light intensity ratio will be at a high level when the unalloyed surface appears periodically in a repeated manner, thus resulting in a partial failure to detect the unalloying, but by reducing the time constant of the falling end relative to the rising end, each of the unalloyed surfaces which appear repeatedly can be detected in a reliable manner.

Figure 17:
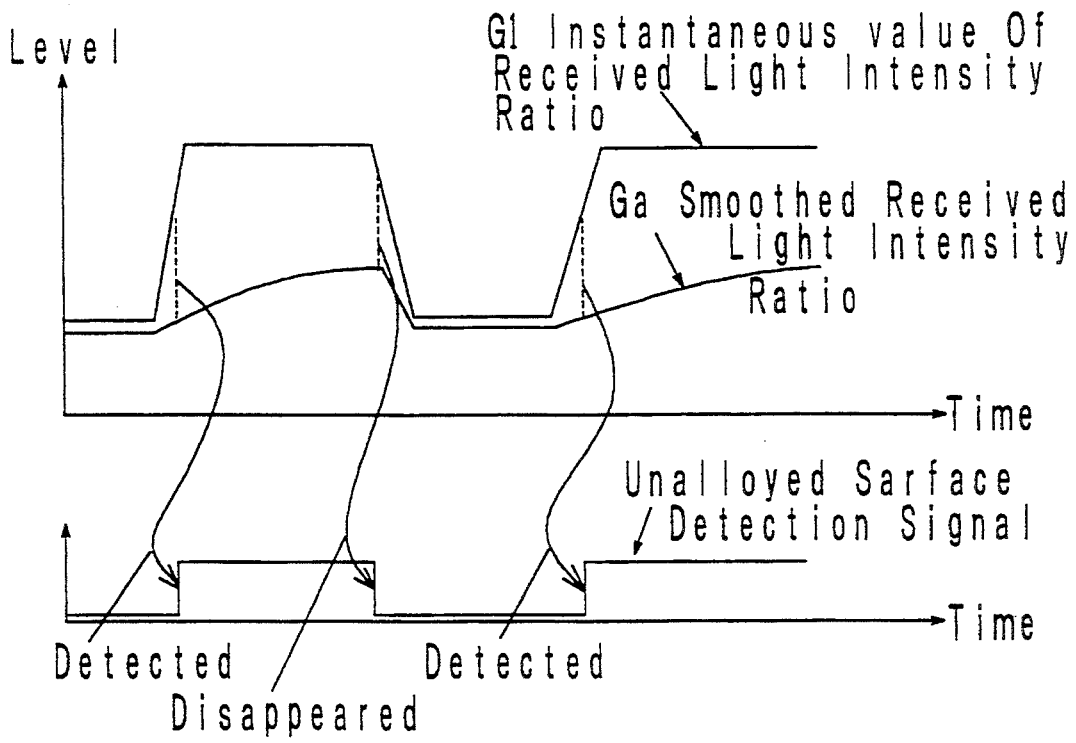
FIG. 17 is a timing chart illustrating an example of operation of an unalloyed surface decision unit 19.

An unalloyed surface decision unit 49 receives the received light intensity ratio (instantaneous value) G1 of the particular point which is output from the degree of alloying calculator 44 and the smoothed received light intensity ratio Ga which is output from the smoothing processor 48, and turns on an unalloyed surface alarm when a difference Gr therebetween remains equal or above a predetermined threshold value gr for a given duration Tr, and turns off the unalloying alarm if Gr (=G1−Ga) remains equal to or less than a threshold value gf for a given time duration Tf. When the unalloyed surface alarm is on, a given warning is displayed on the display 47. When the unalloyed surface appears periodically and repeatedly, the detection of the unalloyed surface is made as many times as it is repeated, as shown in FIG. 17. In this example, the signal processor 7 repeats its operation every 0.3 second, executing the determination of the degree of alloying and the detection of the unalloyed surface.

Figure 18:
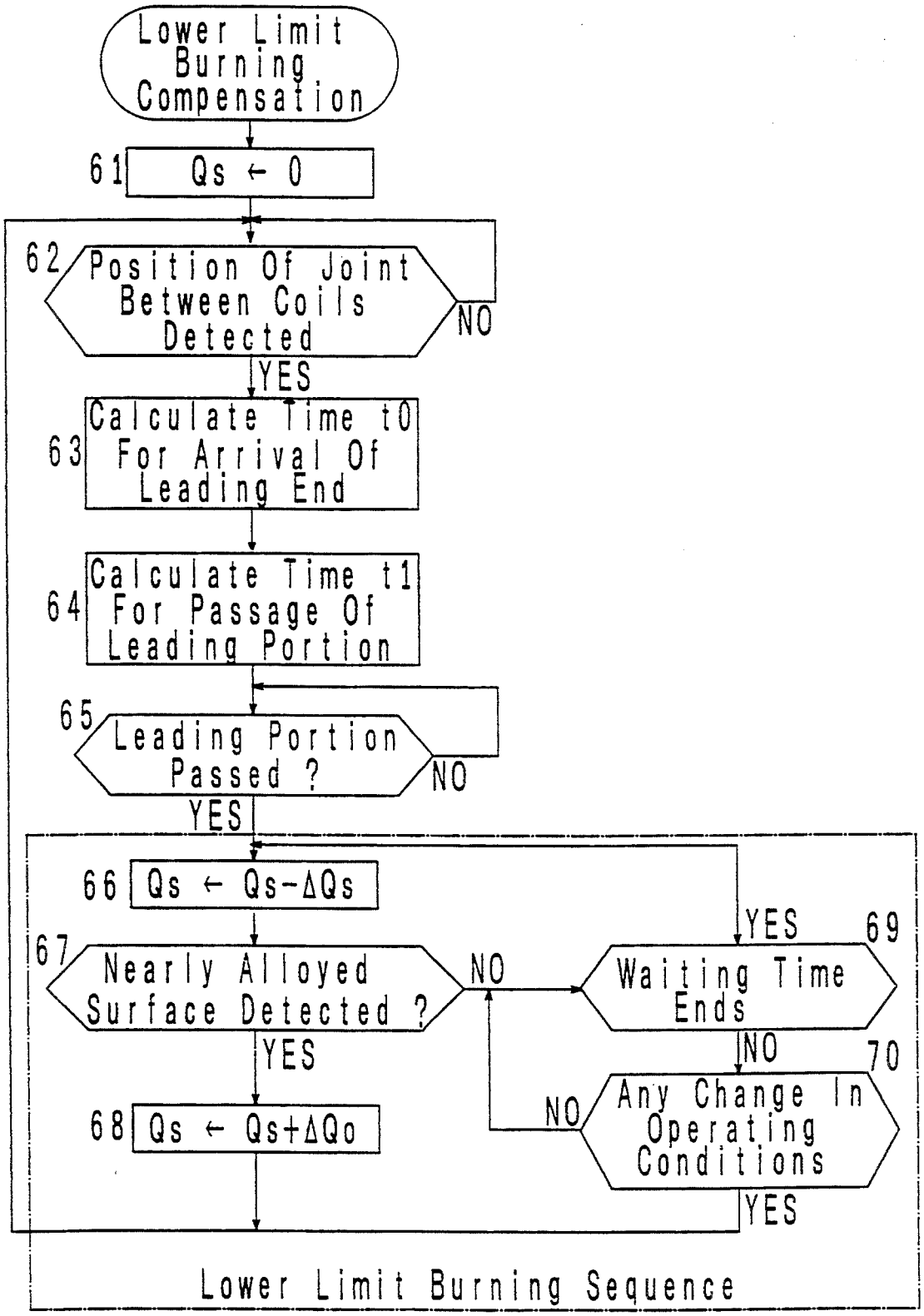
FIG. 18 is a flow chart illustrating the processing by a lower limit burning compensator 24.
Figure 19:
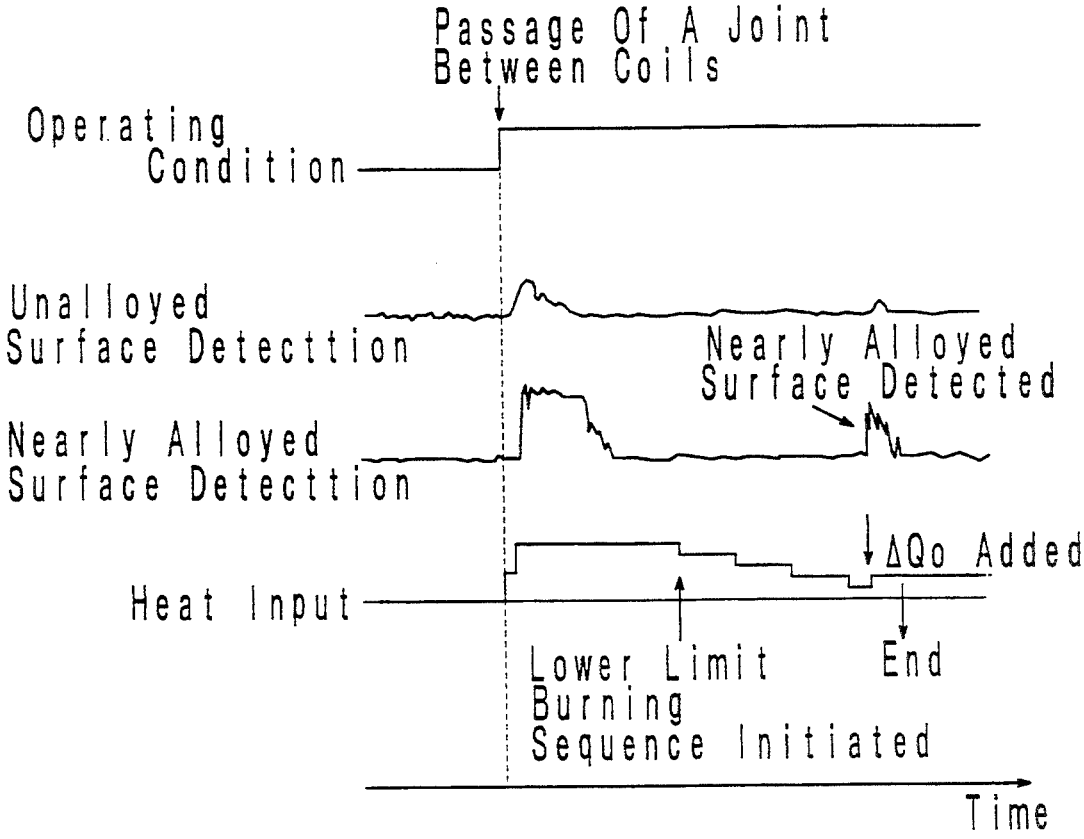
FIG. 19 is a timing chart showing an example of a change in the heat input according to the lower limit burning sequence.

The lower limit burning compensator 24 shown in FIG. 11 performs its controlling operation while referring the degree of alloying G which is output from the image processor 23. The control performed by the lower limit burning compensator 24 is indicated as a flow diagram in FIG. 18, and an example of a change in the heat input is illustrated in FIG. 19. "Detection of unalloyed surface" shown in FIG. 19 is based on a signal which is detected by the reflectivity meter 10 shown in FIG. 11 while "detection of nearly alloyed surface" is based on the degree of alloying G which is output from the image processor 23 shown in FIG. 11. In either instance, the ordinate indicates the degree of insufficiency for the degree of alloying. The control by the compensator 24 will now be described with reference to these Figures.

At step 61, a register Qs which holds a modification to the heat input is cleared for purpose of initialization. It is to be understood that the content of the register Qs is normally output from the lower limit burning compensator 24, and is fed through a switch SW2 to be added to the input of the heat input adjuster 11.

At step 62, a reference is made to information which is output from the process computer 14 and then the operation waits for the detection of the position of a joint between coils which form the band steel 2. As mentioned previously, the band steel 2 comprises a number of coils which are joined together to form a single band in order to allow a continuous treatment. Accoridngly, the steel variety, the plate thickness, the plate width and the like may be often changed at the joints between the coils, with consequent change in the heat input to the alloying furnace 4. When there is a rapid change in the heat input, the process lacks stability, and accordingly it is preferred to inhibit a feedback control. Therefore, in this embodiment, a feedback control including a lower limit burning sequence to be described later is inhibited for an extent of each coil within 50 m from the leading and the trailing end thereof.

At step 63, time t0 when the leading end of each coil reaches the inlet of the alloying furnace 4 is calculated. The process computer 14 is arranged to be capable of detecting the position of the leading end of each coil at various points within the manufacturing equipment, and thus the position of the leading end of each coil can be detected at a point far upstream of the inlet to the alloying furnace 4. Hence, when the process computer 14 detects the leading end of a coil or the joint in the band steel at a given point, such time, a distance from the point where such detection is made to the inlet of the alloying furnace and the conveying speed may be utilized in calculating the time t0.

At step 64, time t1 required for the leading end portion (an extent of 50 m from the leading end) of the coil to pass through the alloying furnace 4 is calculated on the basis of the time t0, the length (50 m) and the band steel conveying speed.

At step 65, the operation waits for the time t1 to come, namely, until the process is stabilized since the occurrence of a change in the heat input entered by the feedforward control system (heat input calculator 13). When time t1 is reached, the lower limit burning sequence is entered.

At step 66, a predetermined incremental value ΔQs is subtracted from the content of the register Qs which holds a modification to the heat input, with a result returned to the register Qs. Thus, each time the step 66 is executed, the actual heat input is decremented by ΔQs.

At step 67, the presence or absence of a nearly alloyed surface (insufficient degree of alloying) detected is examined by referring to the degree of alloying G which is output from the image processor 23. When no such surface is detected, the operation proceeds to step 69, while when such surface is detected, the operation proceeds to step 68.

At step 68, a given value ΔQo is added to the content of the register Qs which holds the modification to the heat input, with a result of addition stored in the register Qs. ΔQo represents a modification by which the heat input must be changed in order to remove the nearly alloyed surface by bringing the band steel to an optimum degree of alloying whenever the nearly alloyed surface initially appears on the surface of the band steel as the heat input is decremented. In this embodiment, a constant is adopted for the modification.

At step 69, a waiting time for the single pass of executing the step 66 in the lower limit burning sequence is examined to see if it has passed. If the waiting time has not passed, the operation proceeds to step 70, but when the waiting time has passed, the operation returns to the step 66 again. The waiting time is chosen to be two to three times the time constant for a resulting change to appear in the degree of alloying G in response to a change in the heat input, plus a given waste time.

At step 70, a reference is made to information which is output from the process computer 14 to examine if there were any change in the operating conditions. In the event there is a change in the operating conditions, the heat input is modified by the feedforward control, and accordingly, the lower limit burning sequence is interrupted in order to stabilize the process.

Thus, referring to FIG. 19, it will be seen that the lower limit burning sequence is initiated after a time since the passage of a joint between the coils when the process has been stabilized, and the heat input is decremented by a given amount ($\Delta Qs$) at a given time interval, and whenever a nearly alloyed surface is detected, a given amount ($\Delta Qo$) is added to the existing heat input to complete the sequence. The nearly alloyed surface can be detected with a very high sensitivity by the determination of the optical reflectivity which utilizes the ITV camera 6 (such sensitivity being higher than that of detecting the unalloyed surface shown in FIG. 19), and accordingly, the incipient condition (or the degree of alloying) when it appears for the first time is substantially fixed with a degree of accuracy. Accordingly, a heat input under such condition may be chosen as a basis, and a given amount $\Delta Qo$ may be added thereto to provide a heat input which corresponds to the optimum degree of alloying.

For a given time interval after changing the heat input by the heat input calculator 13 and for a given time interval after detecting the unalloyed surface by the compensator 22, the switch SW2 is opened in either instance, nullifying the compensation Qs which is output from the lower limit burning compensator 24.

In the described embodiment, the optical reflectivity is determined by the ITV camera 6 utilizing a visible light, but it will be apparent from FIG. 5 that a similar detection is also possible by determining the emissivity in place of the optical reflectivity. In the heat input calculator 13, the heat input may be estimated by one of the equations (6), (7) and (8) instead of the equation (1).

In the described embodiment, the absolute magnitude of the heat input Q has been determined. However, since the calculation of the heat input is repeatedly executed at a given period of time, the control may be modified by repeatedly calculating a deviation of the heat input, with the obtained deviation added to the existing heat input. In such instance, the deviation may be calculated according to one of the equations (9) to (13) where a change in a variable during one calculation period ($\Delta t$) is indicated by $\Delta$.

Fifth Embodiment

Figure 20:
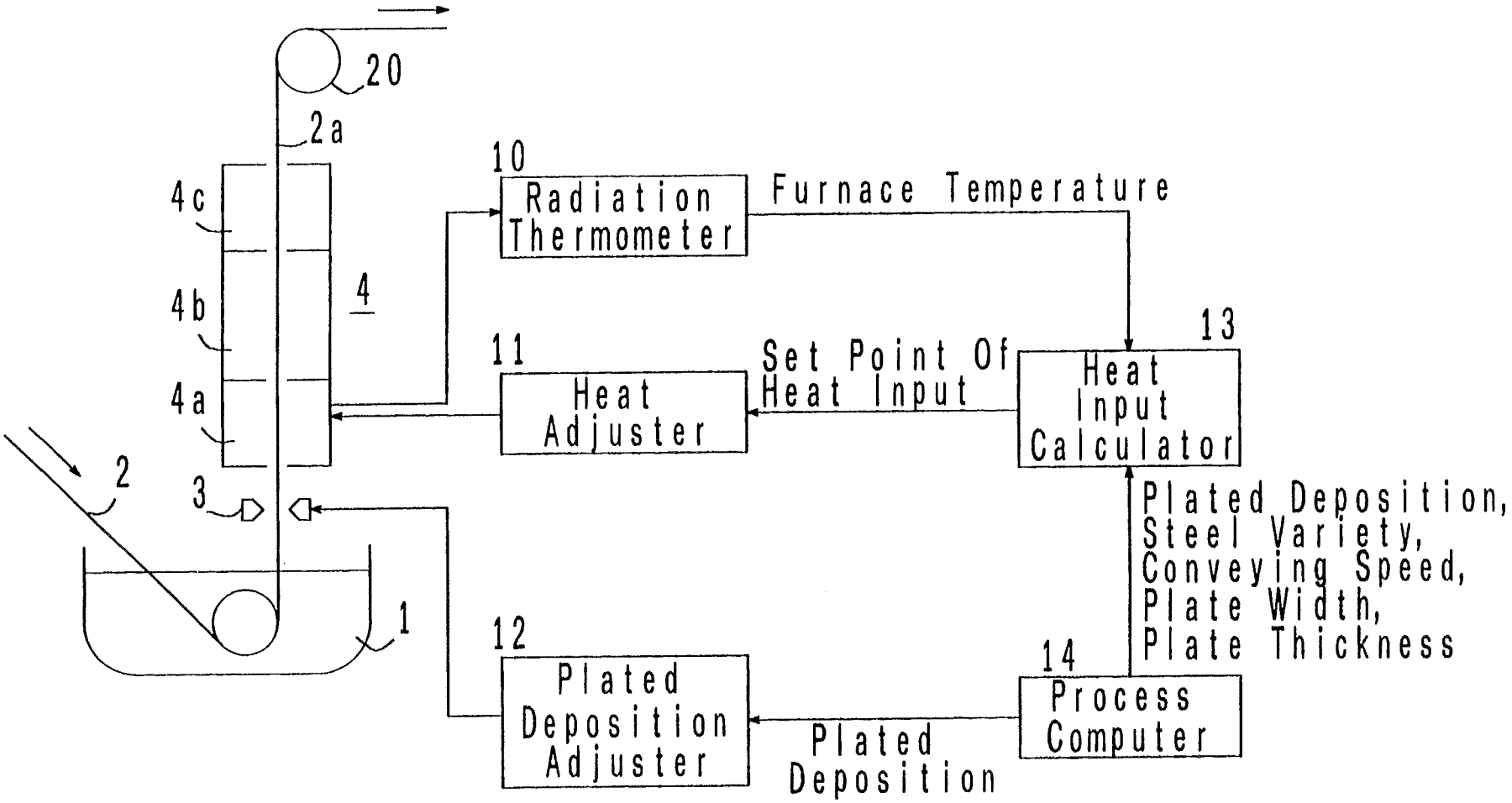
FIG. 20 is a block diagram showing an essential arrangement of a step for manufacturing a hot galvanized and alloyed band steel.

FIG. 20 shows an essential arrangement of a step of manufacturing a hot galvanized and alloyed band steel. Referring to FIG. 20, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone **4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c* to form a zinc-iron alloy plated layer having an iron content on the order of 6 to 13% near its surface. Upon exiting the furnace 4, the band steel 2 is passed around a roll 20** to be conveyed to a successive step.

In this embodiment, heat is supplied to the heating zone **4*a* of the furnace by the combustion of a gas, and the heat input to the heating zone 4*a* is controlled by controling a flow rate of a fuel gas being supplied. This control takes place by a heat adjuster 11 adjusting the opening of a flow rate control valve which is not shown. A set point of the heat input (or target value) which is delivered from a heat input calculator 13 and a compensation from a feedback compensating control system to be described later are applied to the heat adjuster 11. A thermometer 10 determines the furnace temperature in the heating zone 4*a*, with the measured value being input to the heat input calculator 13. A gas flow rate from the nozzle 3 is controlled by the plated deposition adjuster 12, which responds to a plated deposition or a set point thereof which is inputted by controlling the flow rate of gas fed to the nozzle 3. The process computer 14 controls the entire step of manufacturing a hot galvanized and alloyed band steel and delivers a set point of the plated deposition to the plated deposition adjuster 12, and delivers information relating to the plated deposition, the steel variety, the conveying speed, the plate width and the plate thickness to the heat input calculator 13. On the basis of the furnace temperature which is inputted as well as information relating to the plated deposition, the steel variety, the conveying speed, the plate width and the plate thickness, the heat input calculator 13 calculates a set point for the heat input, with a result of calculation applied to the heat input adjuster 11**.

The calculation of the heat input by the heat input calculator 13 will now be described. The alloying process is very complicated and non-linear, and varies in accordance with the operating conditions including the steel variety constant, the plated deposition, the conveying speed or the like in actual operations. Accordingly, in the present embodiment, for purpose of calculating the heat input, a two dimensional space is defined by an axis (x) corresponding to the steel variety constant and another axis (y) corresponding to the plated deposition, and the two dimensional space is divided into six domains, namely, domain 1, domain 2, domain 3, domain 4, domain 5 and domain 6 shown in FIG. 21. A boundary between adjacent domains is not clearly defined. Accordingly, for such boundary area which is shown hatched in FIG. 21, five membership functions X1, X2, Y1, Y2 and Y3 are employed, determining contribution factors of such areas to the respective domains.

More specifically, a contribution factor cl of an arbitrary point (x, y) within the two dimensional space to the domain 1, and similarly a contribution factor c2 to the domain 2, a contribution factor c3 to the domain 3, a contribution factor c4 to the domain 4, a contribution factor c5 to the domain 5 and a contribution factor c6 to the domain 6 are expressed as follows:

$$c1=\mathrm{Min}[X1(x),\ Y1(y)] \tag{24}$$

$$c2=\mathrm{Min}[X1(x), Y2(y)] \quad (25)$$

$$c3=\mathrm{Min}[X1(x), Y3(y)] \quad (26)$$

$$c4=\mathrm{Min}[X2(x), Y1(y)] \quad (27)$$

$$c5=\mathrm{Min}[X2(x), Y2(y)] \quad (28)$$

$$c6=\mathrm{Min}[X2(x), Y3(y)] \quad (29)$$

where

Min [ ]: meaning that a minimum value of those indicated within [ ]is selected

X1( ), X2( ): membership functions of the steel variety constant

Figure 21:
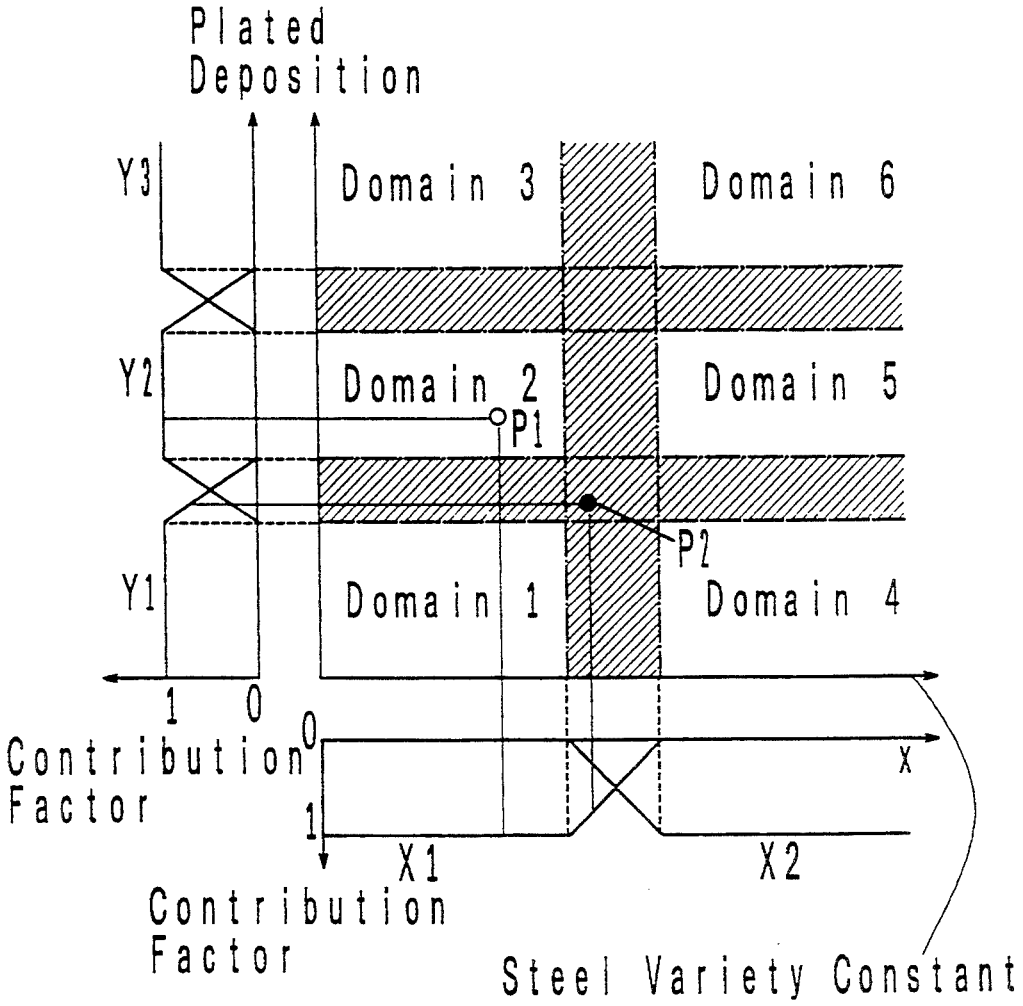
FIG. 21 is a map illustrating the division of the space defining calculation formulae and associated membership functions.

Y1( ) to Y3( ): membership functions of the plated deposition x: value of steel variety constant y: value of plated deposition By way of example, considering a point P1 shown in FIG. 21, membership function X1(x) is equal to 1, X2(x) is equal to 0, Y1(y) is equal to 0, Y2(y) is equal to 1, and Y3(y) is equal to 0. Accordingly, all contributions are equal to zero except for the contribution factor c2 to the domain 2. Consequently, it follows that the point P1 belongs to only the domain 2. But for point P2, the membership functions X1(x), X2(x), Y1(y) and Y2(y) assume values between 0 and 1, and there remain contribution factors to four domains, namely, domain 1, domain 2, domain 4 and domain 5, and threfore the domain to which the point P2 belongs remains indeterminate.

In this embodiment, the heat input Q1 relating to the domain 1, the heat input Q2 relating to the domain 2, the heat input Q3 relating to the domain 3, the heat input Q4 relating to the domain 4, the heat input Q5 relating to the domain 5 and the heat input Q6 relating to the domain 6 are calculated according to the following equations:

$$Q1=a01+\text{all}\times\text{furnace temperature}+a21\times\text{correction of heat input}+a31\times\text{steel variety constant} \quad (30)$$

$$Q2=a02+a12\times\text{furnace temperature}+a22\times\text{correction of heat input}+a32\times\text{steel variety constant} \quad (31)$$

$$Q3=a03+a13\times\text{furnace temperature}+a23\times\text{correction of heat input}+a33\times\text{steel variety constant} \quad (32)$$

$$Q4=a04+a14\times\text{furnace temperature}+a24\times\text{correction of heat input}+a34\times\text{steel variety constant} \quad (33)$$

$$Q5=a05+a15\times\text{furnace temperature}+a25\times\text{correction of heat input}+a35\times\text{steel variety constant} \quad (34)$$

$$Q6=a06+a16\times\text{furnace temperature}+a26\times\text{correction of heat input}+a36\times\text{steel variety constant} \quad (35)$$

$$\text{correction of heat input} = \text{plated deposition} \times \text{conveying speed} \times [1 + k1\ (\text{plate width} - \text{standard value of plate width}) + k2\ (\text{plate thickness} - \text{standard value of plate thickness})] \quad (36)$$

where a01 to a36, k1 and k2 are constants.

The final heat input Q is calculated as a weighted mean according to the equation (37) indicated below, on the basis of the results of calculations Q1 to Q6 for the six domains as well as the contribution factors c1 to c6 to the respective domains:

$$Q=(c1\times Q1+c2\times Q2+c3\times Q3+c4\times Q4+c5\times Q5+c6\times Q6)/(c1+c2+c3+c4+c5+c6) \quad (37)$$

It is to be noted that the number of domains into which the space shown in FIG. 21 is divided and at what location it is divided, the choice of the respective membership functions and the choice of any one of the equations (30) to (36) with which the heat input is estimated may be changed as required. The boundary between the divided domains is determined by referring to data representing the past operating performance and by finding a point where the equation which is used to estimate the heat input undergoes a change. For estimating the heat input, the following equations may be used:

$$Qi = a0i + a1i \times (\text{plated deposition} \times \text{conveying speed}) + a2i \times \text{steel variety constant} \quad (38)$$

$$Qi = a0i + a1i \times \text{plated deposition} + a2i \times \text{conveying speed} + a3i \times \text{steel variety constant} \quad (39)$$

$$Qi = a0i + a1i \times \text{furnace temperature} + a2i \times \text{plated deposition} + a3i \times \text{conveying speed} + a4i \times \text{plate width} + a5i \times \text{plate thickness} + a6i \times \text{steel variety constant} \quad (40)$$

where i: ordinal number of domain

Figure 22:
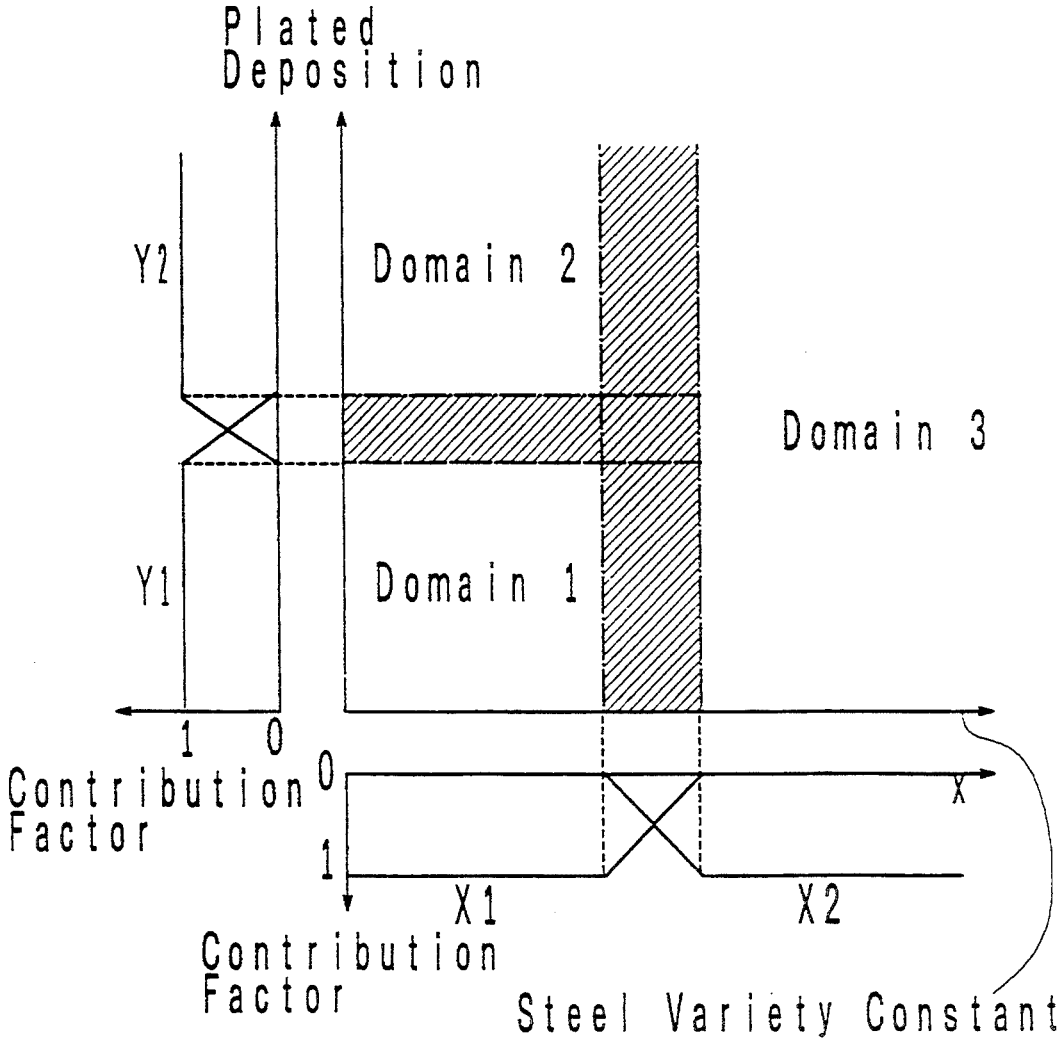
FIG. 22 is a map for a modification shown in FIG. 2.
Figure 23:
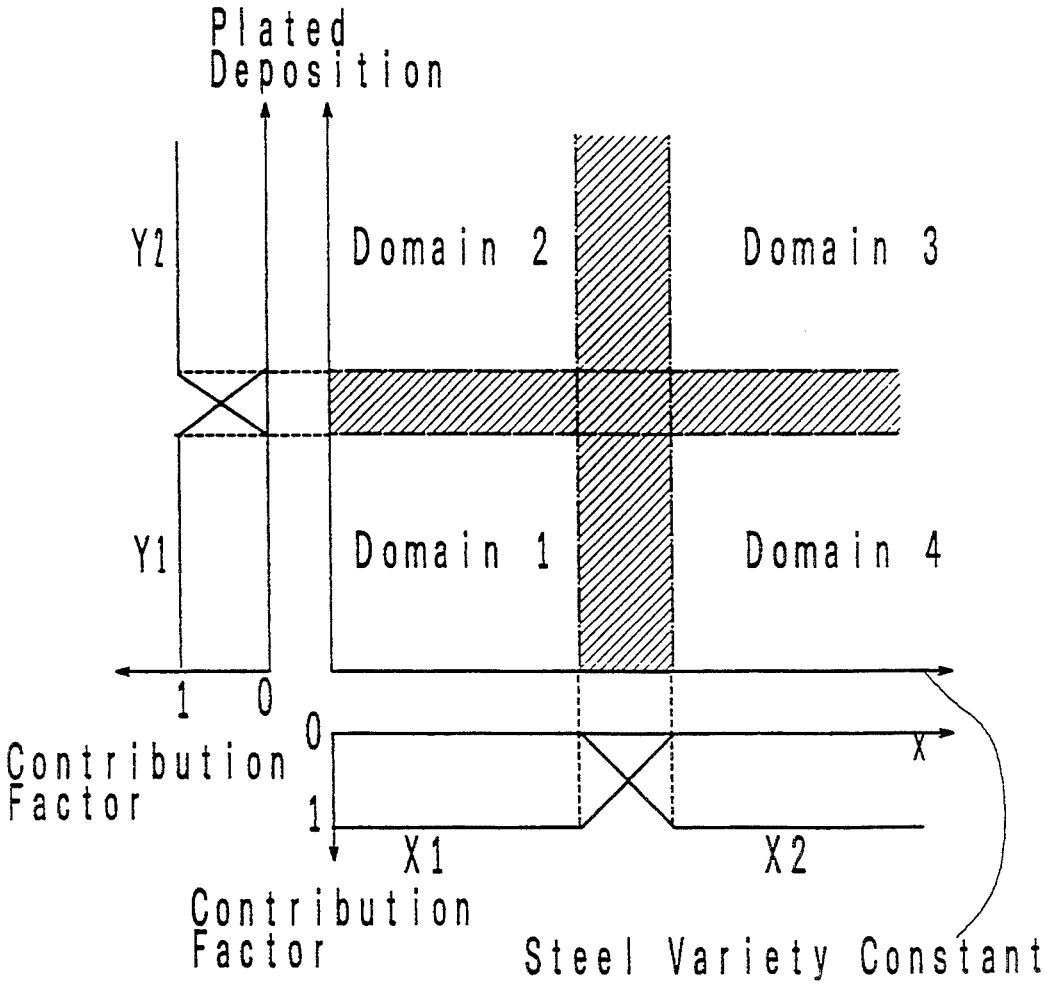
FIG. 23 is a map for a modification shown in FIG. 2.

In the described embodiment, five membership functions X1, X2, Y1, Y2 and Y3 are used to divide the space into six domains. However, it is possible that two membership functions be used for each axis to divide the space into three domains as indicated in FIG. 22, or to divide the space into four domains as illustrated in FIG. 23.

Figure 24:
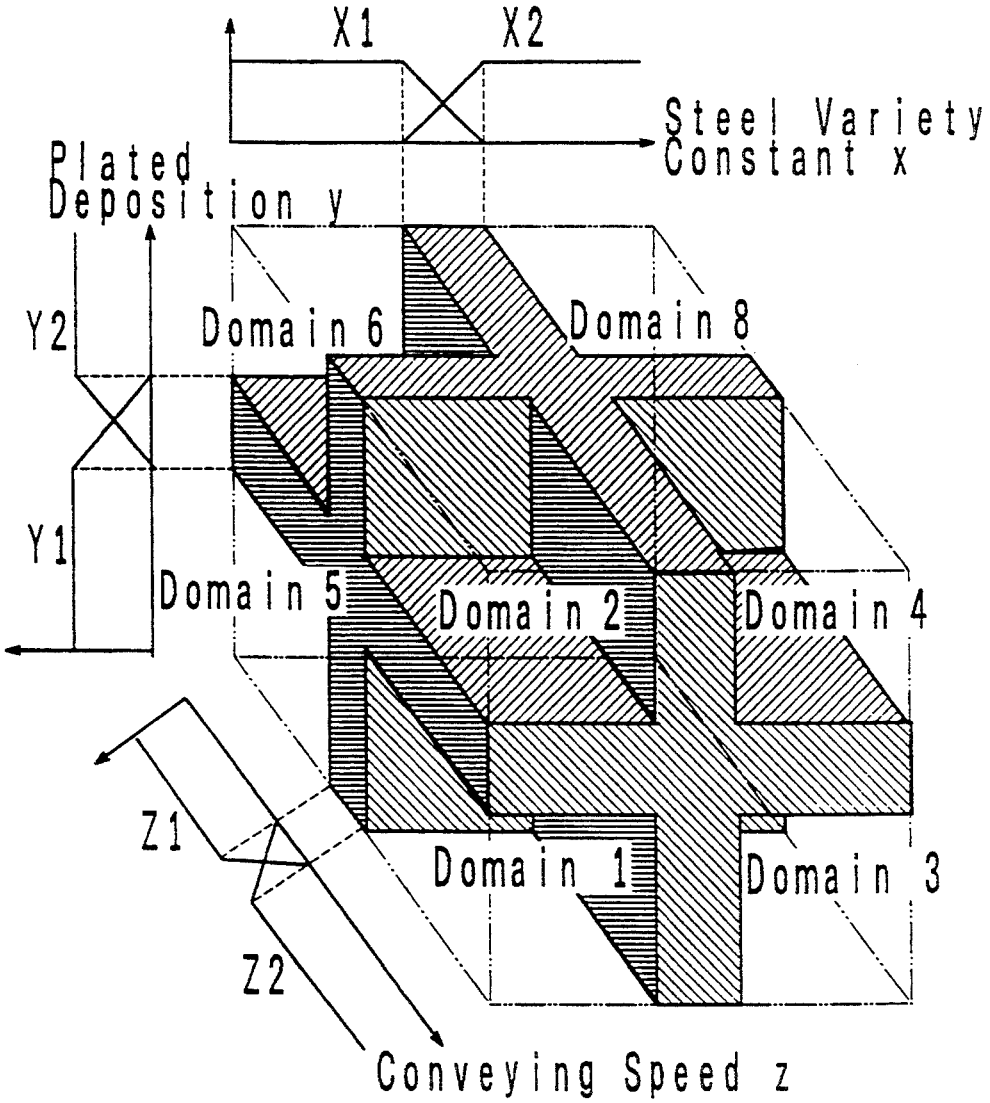
FIG. 24 is a map for an embodiment in which the space defining calculation formulae is a three-dimensional space.

In an embodiment shown in FIG. 24, a three dimensional space is defined by x axis representing the steel variety constant, y axis representing the plated deposition and z axis representing the conveying speed. Two membership functions are allocated to each axis, thus using X1, X2, Y1, Y2, Z1 and Z2 to divide the space into eight domains, or from domain 1 to domain 8. In FIG. 24, a boundary between adjacent domains is shown hatched. Except for the fact that the number of equations used to estimate the heat input is changed as a result of different number of domains which are divided and the use of a different equation to derive a weighted mean, the heat input can be determined in the similar manner as in the previous embodiment.

In the described embodiment, the absolute magnitude of the heat input has been determined. However, in practice, the calculation of the heat input is repeatedly executed at a given period of time, and hence the control may be modified so that a deviation to the heat input be repeatedly calculated, adding the resulting deviation to the existing heat input. In this instance, the deviation may be calculated according to one of the following equations, where a change in a variable during one calculation period ($\Delta t$) is indicted by $\Delta$:

$$\Delta Qi = a0i + a1i \times \Delta \text{ furnace temperature} + a2i \times \Delta \text{ correction of heat input} + a3i \times \Delta \text{ steel variety constant} \quad (41)$$

where $i$ represents an ordinal number of a domain $$\Delta \text{ correction of heat input} = \Delta \text{ [plated deposition} \times \text{conveying speed} \times \{1 + k1 \text{ (plate width} - \text{standard value of plate width)} + k2 \text{ (plate thickness} - \text{standard value of plate thickness)}\}] \quad (42)$$

$$\Delta Q = (c1 \times \Delta Q1 + c2 \times \Delta Q2 + c3 \times \Delta Q3 + c4 \times \Delta Q4 + c5 \times \Delta Q5 + c6 \times \Delta Q6)/(c1 + c2 + c3 + c4 + c5 + c6) \quad (43)$$

(where the space is divided into six domains)

The equations (38), (39) and (40) are modified as follows:

$$\Delta Qi = a0i + a1i \times \Delta \text{ (plated deposition} \times \text{conveying speed)} + a2i \times \Delta \text{ steel variety constant} \quad (44)$$

$$\Delta Qi = a0i + a1i \times \Delta \text{ plated deposition} + a2i \times \Delta \text{ conveying speed} + a3i \times \Delta \text{ steel variety constant} \quad (45)$$

$$\Delta Qi = a0i + a1i \times \Delta \text{ furnace temperature} + a2i \times \Delta \text{ plated deposition} + a3i \times \Delta \text{ conveying speed} + a4i \times \Delta \text{ plate width} + a5i \times \Delta \text{ plate thickness} + a6i \times \Delta \text{ steel variety constant} \quad (46)$$

Sixth Embodiment

Figure 25:
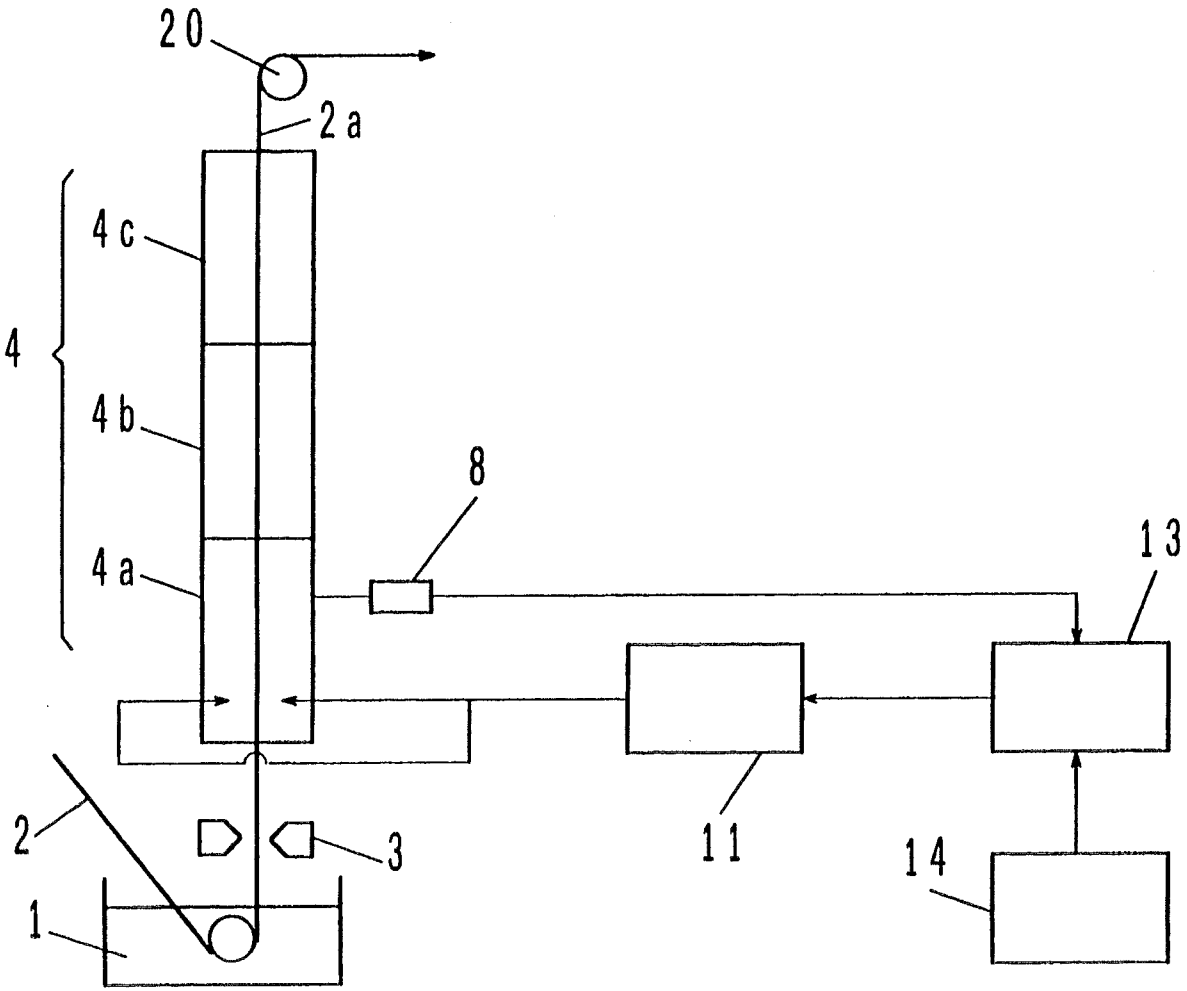
FIG. 25 is a block diagram showing an essential arrangement of a step for manufacturing a hot galvanized and alloyed band steel.

FIG. 25 shows an essential arrangement of a step of manufacturing a hot galvanized and alloyed band steel. Referring to FIG. 25, a band steel 2 is conveyed in a direction indicated by an arrow shown, and is passed through a molten zinc bath 1 to have molten zinc deposited on its surface. Subsequently, as the band steel is passed between nozzles 3, a gas is blown against the band steel to adjust the deposition of the molten zinc, whereupon the band steel is fed into an alloying treatment furnace 4. The interior of the alloying furance 4 is divided into a heating zone 4*a*, an insulated heated zone 4*b* and a cooling zone 4*c*. Upon entering the furance 4, the band steel 2 is initially heated to a plate temperature of 470° C. or above in a rapid manner, and is then maintained at a constant temperature in the heated zone 4*b* where an alloying treatment is applied. Subsequently, it is cooled in the cooling zone 4*c*, to form a zinc-iron alloy plated layer having an iron content on the order of 6 to 13% near its surface. Upon exiting the furnace 4, the band steel 2 is passed around a roll 20 to be conveyed to a successive step.

In this embodiment, heat is applied to the heating zone 4*a* of the alloying furnace by the combustion of gas, and the flow rate of the fuel gas being supplied is controlled to control the heat input to the heating zone 4*a*. This control is performed by adjusting the opening of a flow control valve, not shown, by the heat adjuster 11. A set point (or target value) of the heat which is output from the heat input calculator 13 is applied to the adjuster 11. A furnace thermometer 8 determines the furnace temperature in the heating zone 4*a*, and the measured value is input to the heat input calculator 13. The flow rate of a gas which is delivered through the nozzle 3 is controlled by a plated deposition adjuster, not shown, which controls the gas flow rate in accordance with a set point of the plated deposition which is inputted. A process computer 14 controls the entire step of manufacturing a hot galvanized and alloyed band steel, and delivers a set point for the plated deposition to the plated deposition adjuster, and delivers information relating to the plated deposition, the steel variety, the conveying speed, the plate width and the plate thickness to the heat input calculator 13.

The heat input calculator 13 stores a predetermined relationship between the heat input on one hand and a plated deposition, a steel variety, a conveying speed, a plate width, a plate thickness and a furnace temperature on the other hand. When a furnace temperature is inputted from the thermometer 8 and in response to information relating to the plated deposition, the steel variety, the conveying speed, the plate width and the plate thickness which are input from the process computer 14, it calculates the set point for the heat input, with a result of calculation applied to the heat adjuster 11. The calculation formula which is stored in the heat input calculator 13 is the same as the equation (1). Alternatively, one of the equations (6), (7) or (8) may be used.

Seventh Embodiment

Figure 26:
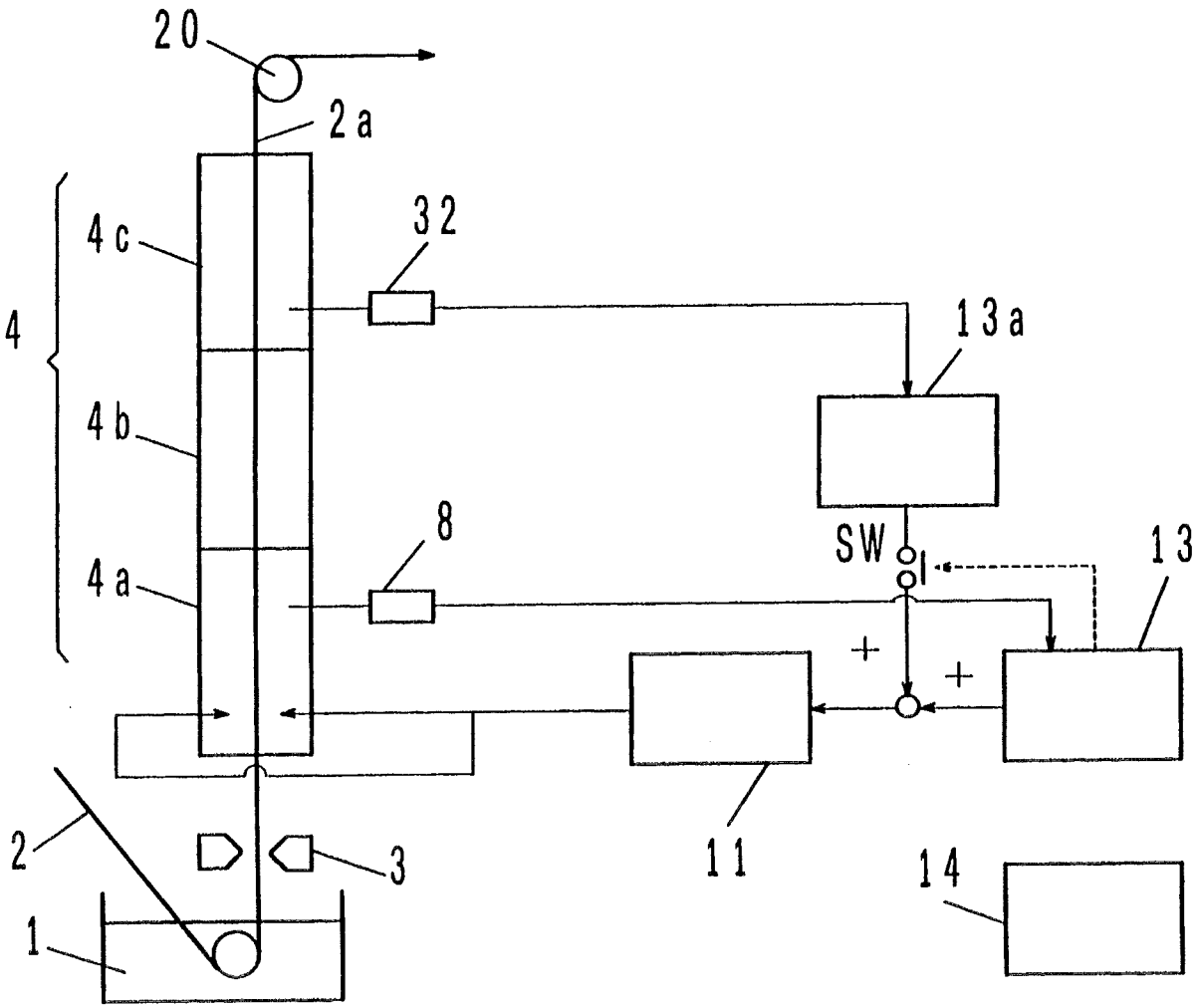
FIG. 26 is a block diagram showing an essential arrangement of a step for manufacturing a hot galvanized and alloyed band steel.

This embodiment is a partial improvement of the sixth embodiment, and has an arrangement as shown in FIG. 26. Specifically, a degree of alloying measuring unit 32 is disposed at the outlet of the heated zone 4*b*, thus providing a result of measurement of the actual degree of alloying of the band steel to the feedback control. A second calculator 13a which is provided anew, provides a compensation to adjust the heat input on the basis of the detected degree of alloying. An output from the second calculator 13*a* is fed through a switch SW controlled by the heat input calculator 13 to be input to the control system.

The switch SW is normally maintained on, allowing an adjustment of the heat input in accordance with the degree of alloying which is fed back. However, a change in at least one of the plated deposition, the steel variety, the conveying speed, the plate width and the plate thickness is inputted from the process computer 14, the switch SW is turned off until a new equibrillium is reached, thus inhibiting the feedback control which responds to the detected degree of alloying.

Figure 27:
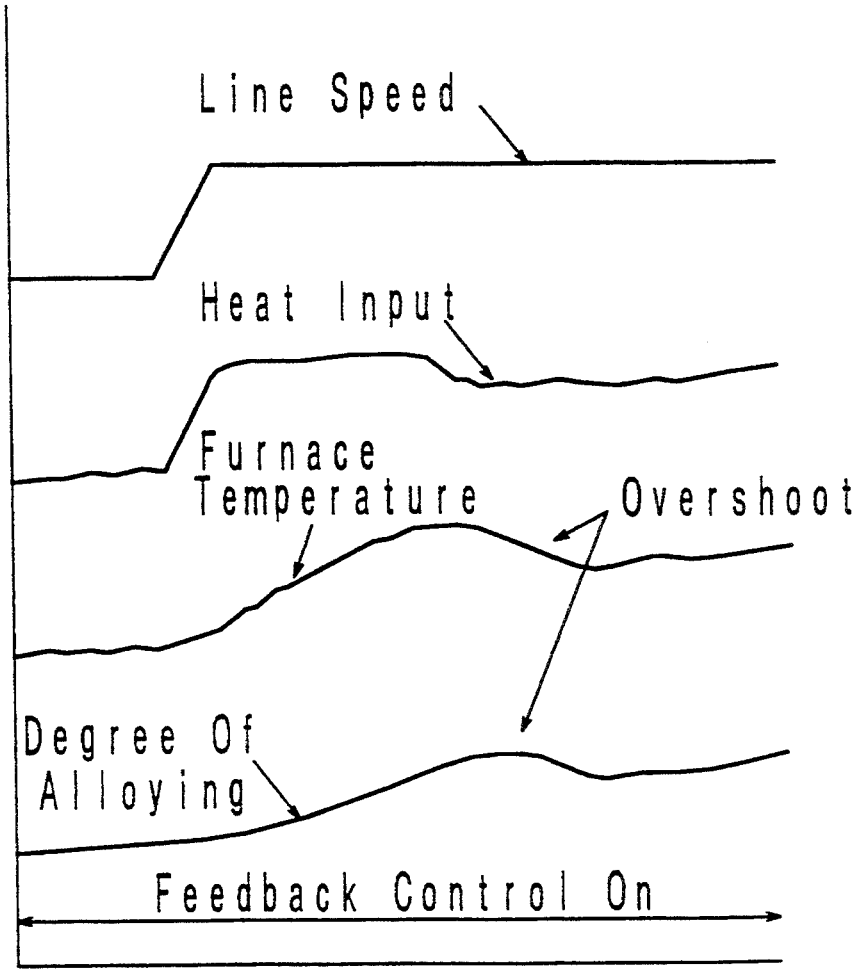
FIG. 27 is a timing chart illustrating changes in the process when a line speed is changed.
Figure 28:
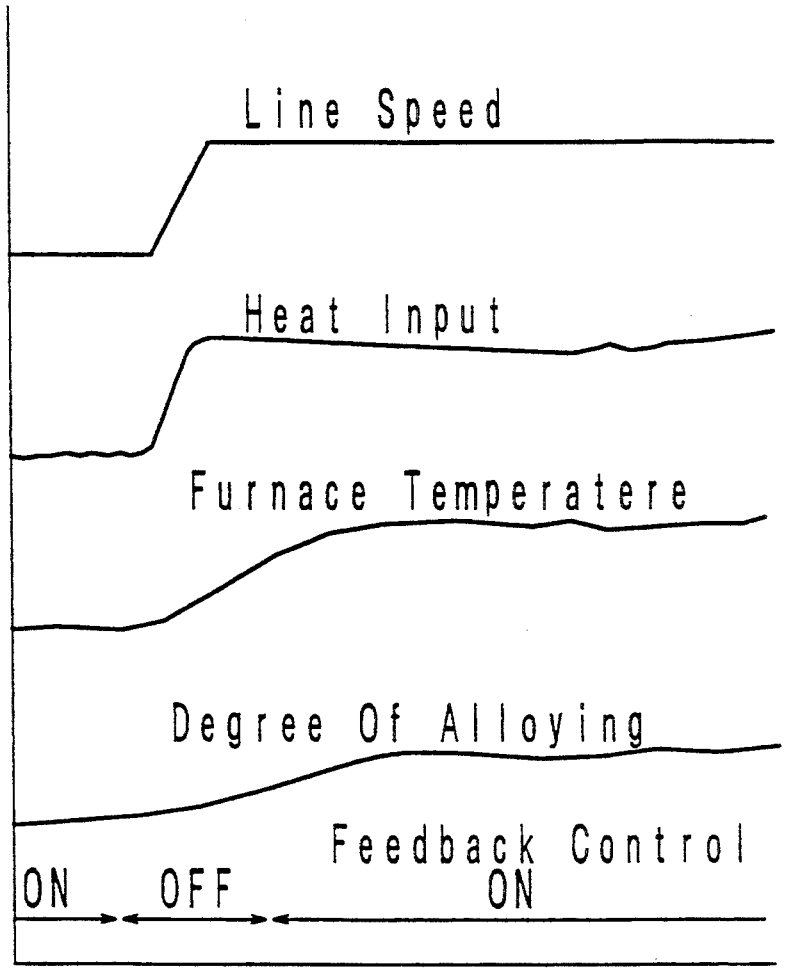
FIG. 28 is a timing chart illustrating changes in the process when the line speed and the control are changed.

It is recognized that there exists a time lag in the change in the furnace temperature within the heating zone and the heated zone, and there exists also a time lag from a change of the temperature applied to the heating zone until the resulting influence is reflected as a change in the degree of allowing at the outlet of the heated zone. Accordingly, if the feedback control is maintained on, the control may overshoot as shown in FIG. 27, for example, when the plated deposition, the steel variety, the conveying speed, the plate width and/or plate thickness is changed. To accommodate for this, the feedback control is temporarily inhibited whenever the plated deposition, the steel variety, the conveying speed, the plate width and/or the plate thickness is changed as in the present embodiment, thus effectively preventing the occurrence of an overshoot as illustrated in FIG. 28.

Incidentally, it is to be noted that when the plated deposition, the steel variety, the conveying speed, the plate width and/or the plate thickness is changed, an equivalent effect can be achieved by reducing a control gain below a normal value without completely inhibiting the feedback control through the switch SW.

It is to be noted that the first embodiment is effective to solve the first task mentioned initially; the second embodiment is effective to solve the second task; the third embodiment is effective to solve the third task; the fourth embodiment is effective to solve the fourth task; and the fifth embodiment is effective to solve the fifth task.

What is claimed is:

1. A method of calculating a heat input to an alloying furnace through which a hot galvanized band steel is passed to form an alloyed layer of iron and zinc on the band steel by a heating action therein, comprising the steps of:

conveying a band steel through an alloying furnace which includes heat input means, and forming a plated deposition on said band steel in said alloying furnace comprising an alloyed layer of iron and zinc, wherein said steel band has a steel variety constant and an amount of the plated deposition;

choosing a space in which a formula for calculating the heat input is defined as a two dimensional or higher dimensional space containing at least a first axis corresponding to said steel variety constant and a second axis corresponding to said amount of the plated deposition;

dividing the space into two or more independent domains and boundary regions located between the plurality of independent domains;

providing an independent calculation formula for each of the plurality of independent domains, wherein said independent calculation formula defines a relationship between heat input and a condition including at least said steel variety constant and said amount of the plated deposition;

providing two or more membership functions for each axis which determine a contribution factor of a boundary region to each independent domain;

calculating a contribution factor of the steel variety constant to each independent domain on the basis of the steel variety constant which is inputted and its associated membership function;

calculating a contribution factor of the plated deposition to each independent domain on the basis of the plated deposition which is inputted and its associated membership function;

obtaining a heat input by performing a calculation which utilizes the calculation formulae allocated to respective independent domains and the respective calculated contribution factors;

and using said obtained heat input to control said heat input means of said alloying furnace thereby controlling said forming of said iron and zinc alloyed layer plated deposition on said band steel.

2. A method of calculating a heat input to an alloying furnace according to claim 1 in which the space in which the calculation formula for calculating the heat input is defined is chosen as a three dimensional space containing a steel variety constant axis, a plated deposition axis and a conveying speed axis;

dividing the space into two or more independent domains and boundary regions located between the plurality of independent domains;

providing an independent calculation formula for each independent domain;

providing two or more membership functions for each axis which determine a contribution factor of a boundary region to each independent domain;

calculating a contribution factor of the steel variety constant to each independent domain on the basis of the steel variety constant which is inputted and its associated membership function;

calculating a contribution factor of the plated deposition to each independent domain on the basis of the plated deposition which is inputted and its associated membership function;

calculating a contribution factor of the conveying speed to each independent domain on the basis of the conveying speed which is inputted and its associated membership function;

and obtaining a heat input by performing a calculation which is based on the calculation formulae allocated to the respective independent domains and the respective calculated contribution factors.

3. A method of calculating a heat input to an alloying furnace including a heating zone and an insulated heated zone, through which a hot galvanized band steel is sequentially passed to form an alloyed layer of iron and zinc on the band steel by a heating action therein, comprising the steps of:

conveying a band steel comprising a selected steel variety through an alloying furnace which includes heat input means and forming a plated deposition on said band steel in said alloying furnace comprising an alloyed layer of iron and zinc;

establishing a formula defining a correlation between a heat input and at least the steel variety, the plated deposition and a conveying speed of the band steel, and storing said formula in computer memory;

inputting information which relates to at least the steel variety, the plated deposition and the conveying speed of the band steel;

determining a heat input on the basis of the information inputted and the stored correlation between such information and the heat input;

using said determined heat input to control said heat input means of said alloying furnace thereby controlling said forming of said iron and zinc alloyed layer plated deposition on said band steel.

4. A method of calculating a heat input to an alloying furnace according to claim 3, further including the steps of:

detecting a degree of alloying of the band steel at the outlet of the heated zone;

feeding back the detected degree of alloying to the control;

and correcting the heat input in accordance with the degree of alloying.

5. A method of calculating a heat input to an alloying furnace according to claim 4, in which whenever the steel variety, the plated deposition or the conveying speed of the band steel is changed, a correction of the heat input in accordance with the detected degree of alloying is temporarily interrupted.

* * * * *